US012053034B2

(12) United States Patent
Szilagyi

(10) Patent No.: US 12,053,034 B2
(45) Date of Patent: Aug. 6, 2024

(54) GARMENT WITH MOTION-SUPPORTING COMPRESSION ZONES AND BODY-SHAPING COMPRESSION ZONES

(71) Applicant: adidas AG, Herzogenaurach (DE)

(72) Inventor: Dora Szilagyi, Brooklyn, NY (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 16/684,326

(22) Filed: Nov. 14, 2019

(65) Prior Publication Data

US 2021/0145084 A1 May 20, 2021

(51) Int. Cl.

| | |
|---|---|
| ***A41D 1/04*** | (2006.01) |
| ***A41D 1/08*** | (2018.01) |
| ***A41D 13/00*** | (2006.01) |

(52) U.S. Cl.

CPC ..... *A41D 1/04* (2013.01); *A41D 1/08* (2013.01); *A41D 13/0015* (2013.01); *A41B 2400/38* (2013.01); *A41D 2400/38* (2013.01); *A41D 2500/10* (2013.01); *A41D 2600/10* (2013.01)

(58) Field of Classification Search

CPC ..... A41D 1/04; A41D 1/08; A41D 13/0015; A41D 2500/10; A41D 2600/10; A41D 2400/38; A43C 3/00; D04B 1/24; D04B 1/246; D10B 2501/04

See application file for complete search history.

(56) References Cited

U.S. PATENT DOCUMENTS

| | | | | |
|---|---|---|---|---|
| 5,431,030 | A * | 7/1995 | Ishizaki | A41B 9/00 2/243.1 |
| 5,996,120 | A * | 12/1999 | Balit | A41D 13/0017 2/243.1 |
| 7,395,557 | B1 * | 7/2008 | Ledyard | A41B 9/06 2/113 |
| 7,546,751 | B2 * | 6/2009 | Lutz | A41D 7/00 66/171 |
| 9,850,601 | B2 * | 12/2017 | Shen | D04B 21/06 |
| 11,213,082 | B1 * | 1/2022 | Yang | A41D 1/08 |
| 11,246,360 | B1 * | 2/2022 | Hanson Allen | A41B 9/06 |
| 2002/0022433 | A1 * | 2/2002 | Yeung | A41C 3/0057 450/70 |
| 2007/0074328 | A1 * | 4/2007 | Melhart | A41D 13/0015 2/69 |
| 2009/0025115 | A1 * | 1/2009 | Duffy | A41D 31/185 2/69 |
| 2010/0011479 | A1 | 1/2010 | Onoda et al. | |

(Continued)

FOREIGN PATENT DOCUMENTS

| | | | |
|---|---|---|---|
| CN | 109938423 | A | 6/2019 |
| FR | 2996731 | A1 | 4/2018 |

*Primary Examiner* — Katherine M Moran
*Assistant Examiner* — Haley A Smith
(74) *Attorney, Agent, or Firm* — Sterne, Kessler, Goldstein & Fox P.L.L.C.

(57) ABSTRACT

A sports garment includes a textile forming two or more compression zones. The compression zones include a motion-supporting compression zone configured to apply a first compressive force to a first area of a body and a body-shaping compression zone configured to apply a second compressive force to a second area of the body. The first compressive force supports a motion of the first area of the body. The second compressive force shapes the second area of the body.

19 Claims, 19 Drawing Sheets

(56) References Cited

U.S. PATENT DOCUMENTS

| | | | | |
|---|---|---|---|---|
| 2010/0184355 | A1* | 7/2010 | Kennedy | A41C 1/06 66/171 |
| 2011/0104983 | A1* | 5/2011 | Upton | A41D 1/22 450/1 |
| 2011/0209263 | A1* | 9/2011 | Suzuki | A41D 31/185 2/67 |
| 2013/0254971 | A1* | 10/2013 | Galluzzo | A41D 31/18 2/115 |
| 2014/0148741 | A1* | 5/2014 | Moran | A41D 31/18 601/84 |
| 2014/0208479 | A1* | 7/2014 | Lambertz | A41D 27/10 2/69 |
| 2014/0366585 | A1* | 12/2014 | Shen | D04B 21/207 66/175 |
| 2016/0235126 | A1* | 8/2016 | Roscoe | A41D 1/04 |
| 2016/0353810 | A1* | 12/2016 | Barnes | A41C 5/00 |
| 2018/0279694 | A1* | 10/2018 | Theno | A41B 9/12 |
| 2018/0310634 | A1* | 11/2018 | Blakely | A41B 11/00 |
| 2018/0317570 | A1* | 11/2018 | Diaz | A41C 3/0014 |
| 2019/0075853 | A1* | 3/2019 | Altmann | A41B 9/06 |
| 2019/0297956 | A1 | 10/2019 | Diaz et al. | |
| 2019/0335822 | A1* | 11/2019 | Jesch | A41D 27/28 |
| 2021/0140079 | A1* | 5/2021 | Szilagyi | D04B 21/16 |

* cited by examiner

GARMENT WITH MOTION-SUPPORTING COMPRESSION ZONES AND BODY-SHAPING COMPRESSION ZONES

FIELD

The present disclosure relates to sports garments. In particular, the present disclosure relates to sports garments including compression zones for supporting movement (e.g., during physical activity) and for body shaping.

BACKGROUND

Shapewear garments used to contour and support the body typically are not suitable for wear during physical activities. These garments usually lack moisture-wicking and moisture-absorption capabilities. In addition, they often include hardware, such as clasps and boning, and may limit the wearer's range of motion. These features may make the garments uncomfortable and impractical to be worn while engaging in physical activity. Additionally, typical shapewear garments are generally not worn on their own, but rather underneath other clothing because they are often too lightweight and sheer to be worn without another article of clothing over them.

Conversely, sports garments that include compression zones to provide support for movement during physical activity and/or contribute to muscle recovery are generally developed for high-level athletes who have low body fat. These sports garments can look unflattering on bodies having a higher percentage of body fat.

BRIEF SUMMARY

The present disclosure is directed to sports garments, particularly sports garments including compression zones which are designed to support movement during physical activity and compressions zones which are designed to contour and shape the body for a flattering appearance.

Some embodiments are directed to a sports garment that includes a textile that forms two or more compression zones. In some embodiments, the compression zones include a motion-supporting compression zone that applies a first compressive force to a first area of a body and a body-shaping compression zone that applies a second compressive force to a second area of the body. In some embodiments, the first compressive force supports a motion of the first area of the body and the second compressive force shapes the second area of the body.

In some embodiments, the first area of the body includes at least one of a knee, an elbow, a shoulder, a back, a leg, or an arm. In some embodiments, the second area of the body includes at least one of an abdominal region, a gluteal region, a waist region, a breast region, an inner thigh, an inner knee, an outer thigh, or a shoulder blade.

In some embodiments, the sports garment is an outer garment. In some embodiments, the sports garment is opaque. In some embodiments, the textile includes a mesh, single jersey, or half Milano structure. In some embodiments, the sports garment is at least one of a shirt, pants, shorts, leggings, or swimwear. In some embodiments, the sports garment does not include any hardware.

Some embodiments are directed to a sports garment that includes a first knitted textile that supports a motion of a first area of a body, a second knitted textile that shapes a second area of the body, and a third knitted textile that includes a mesh, single jersey, or half Milano structure. In some embodiments, the third knitted textile is disposed at a third area of the body. In some embodiments, the first knitted textile, the second knitted textile, and the third knitted textile are coupled seamlessly together.

In some embodiments, the first knitted textile, the second knitted textile, and the third knitted textile are coupled together by knitting. In some embodiments, the first knitted textile and the second knitted textile are opaque. In some embodiments, the first area of the body includes at least one of a knee, an elbow, a shoulder, a back, a leg, or an arm. In some embodiments, the second area of the body includes at least one of an abdominal region, a gluteal region, a waist region, a breast region, an inner thigh, an inner knee, an outer thigh, or a shoulder blade. In some embodiments, the sports garment is an outer garment.

Some embodiments are directed to a method for manufacturing a sports garment that includes knitting a textile, modifying a first characteristic of the knitting to form a motion-supporting compression zone in the textile, and modifying a second characteristic of the knitting to form a body-shaping compression zone in the textile.

In some embodiments, the knitting includes circular knitting. In some embodiments, the first characteristic includes at least one of a type of yarn, a type of knitting stitch, or a density of the knit. In some embodiments, the first characteristic is a different characteristic than the second characteristic. In some embodiments, the sports garment includes at least one of a shirt, pants, shorts, leggings, or swimwear. In some embodiments, knitting the textile forms the sports garment.

BRIEF DESCRIPTION OF THE DRAWINGS/FIGURES

DETAILED DESCRIPTION

The present invention(s) will now be described in detail with reference to embodiments thereof as illustrated in the accompanying drawings. References to "some embodiments", "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Shapewear garments are used to contour and support the body to help the wearer feel more confident. Shapewear may create a more flattering appearance by highlighting desired areas of the wearer's body and shaping other areas of the body that are of concern. However, shapewear garments typically are not suitable for wear during physical activities. Rather, shapewear garments often include hardware, such as clasps and boning to aid in cinching the body, and are often made from sheer, delicate fabric that is only suited for undergarments. Therefore, these shapewear garments are not suitable to be worn on their own, and are too uncomfortable to be worn during physical activity, since they typically restrict motion. Furthermore, the fabric used to make the shapewear does not provide breathability or moisture wicking, and are not suitable for wear during perspiration.

Conversely, sports garments used to improve the efficiency of physical activity (e.g., compression garments) are not well suited as shapewear. The areas of compression in these garments are not typically the same areas that are usually cinched by shapewear. Furthermore, these garments are generally designed for athletes who have a low body fat percentage, so they often do not fit the bodies of people who have larger amounts of body fat and are not flattering. Accordingly, improved sports garments and improved shapewear that allow the wearer to feel more comfortable and have more confidence while engaging in physical activity are desirable.

Figure 1:
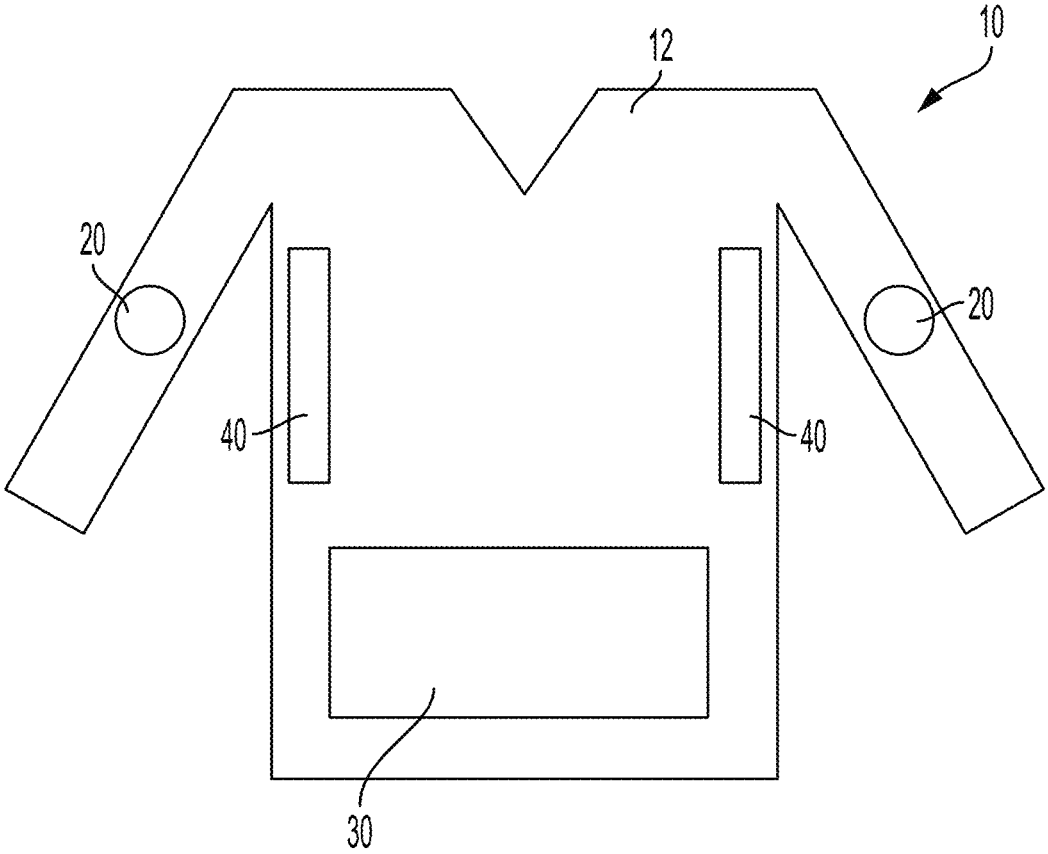
FIG. 1 illustrates a schematic view of a sports garment according to some embodiments.

The sports garments described herein provide an improvement over existing compression garments. In some embodiments, a sports garment may include one or more zones to accomplish particular functions (e.g., shape an area of the wearer's body, support a motion of an area of the wearer's body, provide ventilation/moisture wicking properties). For example, a sports garment 10 is shown in FIG. 1 as a schematic. Although sports garment 10 generally has an outline of a shirt, sports garment 10 represents any type of sports garment. For example, sports garment 10 may be a long-sleeved shirt, short-sleeved shirt, tank top, pants, shorts, leggings, bras, undergarments, swim gear, or any other type of sports apparel. In some embodiments, sports garment 10 is an outer garment (i.e., it is intended to be worn as an outer layer). For example, sports garment 10 may be opaque. In some embodiments, sports garment 10 may be made of a knitted textile 12. Knitted textile 12 may have moisture wicking and absorption properties. For example, the yarn material for knitted textile 12 may have moisture wicking and absorption properties. In some embodiments, the yarn material for knitted textile 12 is made from polyester, polyamide, elastane, nylon, polypropylene, cotton, or viscose.

Sports garment 10 may include different zones 20, 30, 40. In some embodiments, knitted textile 12 forms the different zones 20, 30, 40. In some embodiments, knitted textile 12 may form the entire sports garment 10. Thus, in some embodiments, sports garment 10 does not include any hardware (e.g., clasps, corseting or bone like structures, etc.).

In some embodiments, sports garment 10 includes one or more motion-supporting compression zones 20. Motion-supporting compression zones 20 may be configured to support physical activity of the wearer. For example, motion-supporting compression zones 20 may support the wearer's motion during physical activity by increasing efficiency of exercise or promoting better recovery. In some embodiments, motion-supporting compression zones 20 may provide compressive forces to constrict the wearer's muscles, thus supporting motion of the wearer. Motion-supporting compression zones 20 may improve physical activity in other ways, including providing joint support (e.g., elbows, knees, shoulders, etc.) and supporting circulatory systems (e.g., in the lower ligaments).

Although FIG. 1 shows motion-supporting compression zones 20 disposed at an elbow of sports garment 10, motion-supporting compression zones 20 may be disposed at any location, including on the upper body and the lower body. In some embodiments, motion-supporting compression zones 20 may be located, for example, at the knee, the elbows, the shoulders, the upper back, a lower leg, and/or a lower arm. Any number of motion-supporting compression zones 20 may be included in sports garment 10.

In some embodiments, sports garment 10 includes one or more body-shaping compression zones 30. Body-shaping compression zones 30 may be configured to shape and contour the wearer's body. In some embodiments, body-shaping compression zones 30 may provide compressive forces to particular areas of the body to achieve the desired shaping. For example, body-shaping compression zone 30 may contract around a wearer's abdomen to provide a slimming appearance.

Although FIG. 1 shows body-shaping compression zones 30 disposed at an abdomen of sports garment 10, body-shaping compression zones 30 may be disposed at any location, including on the upper body and the lower body. In some embodiments, body-shaping compression zones 30 may be located, for example, at the front abdominals, glutes (e.g., to lift the glutes), the waistline, the breasts, the upper arms, the inner thighs, the inner knees, the outer thighs, the shoulder blades (e.g., to shape fatty deposits at the shoulder blade). Any number of body-shaping compression zones 30 may be included in sports garment 10.

In some embodiments, sports garment 10 includes one or more ventilation zones 40. Ventilation zones 40 may be configured to provide improved breathability of the sports garment 10. In some embodiments, ventilation zones 40 comprise a mesh. Although FIG. 1 shows ventilation zones 40 disposed at a side of the torso of sports garment 10, ventilation zones 40 may be disposed at any location, including on the upper body and the lower body. In some embodiments, ventilation zones 40 may be located, for example, at any portion of the legs, arms, back, armpits, and/or torso. Any number of ventilation zones 40 may be included in sports garment 10.

Figure 3:
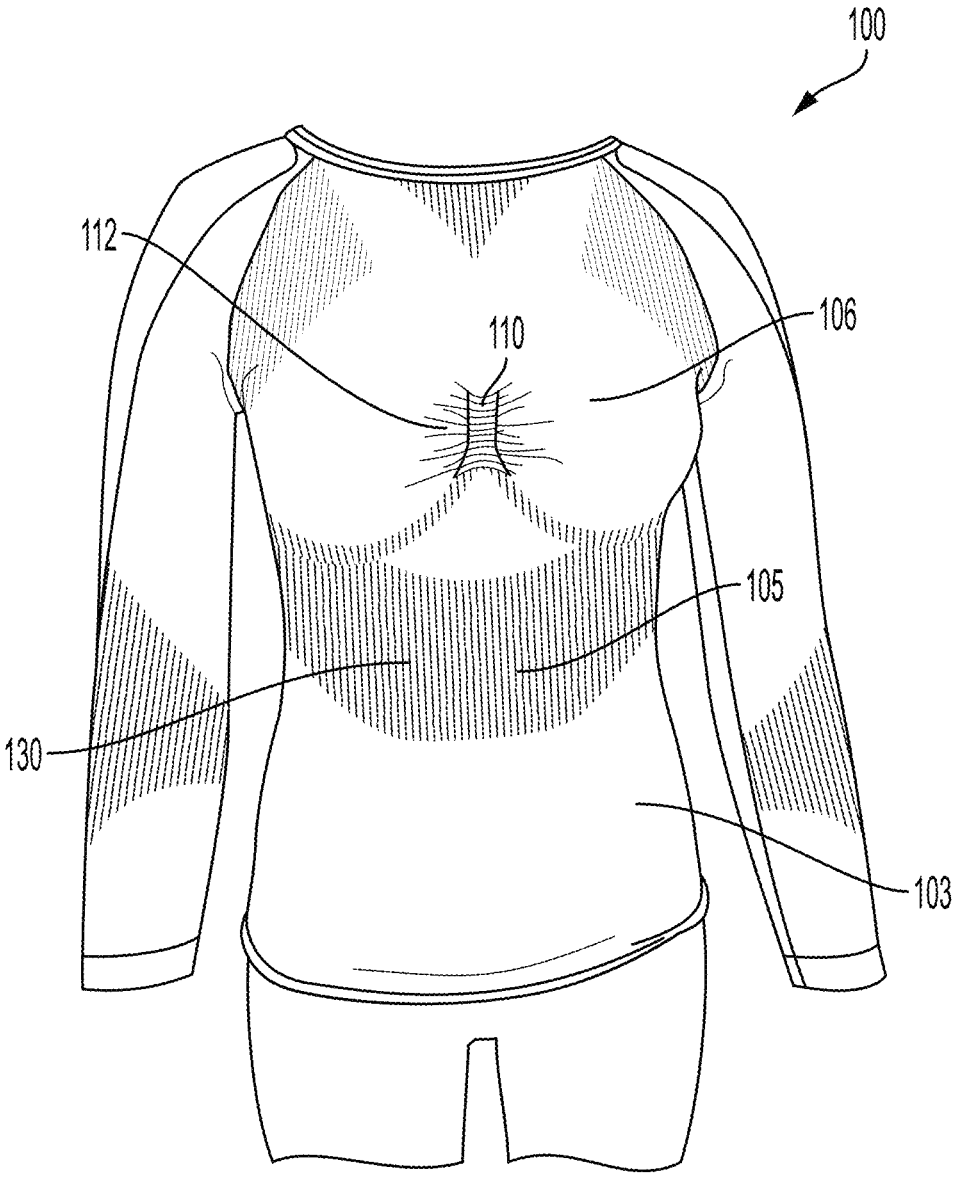
FIG. 3 illustrates a front view of a sports garment according to some embodiments.
Figure 4:
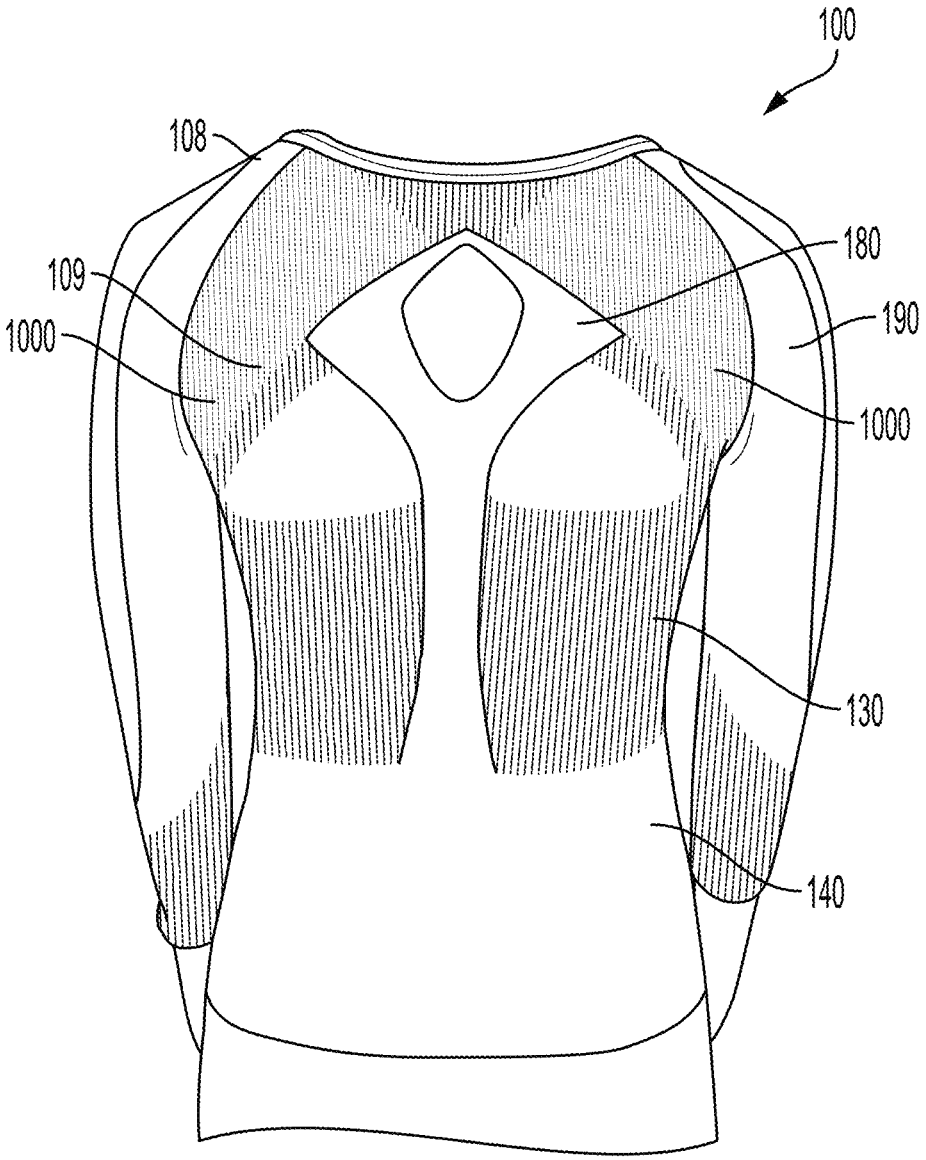
FIG. 4 illustrates a rear view of a sports garment according to some embodiments.

Exemplary sports garments 10 that include various zones 20, 30, 40 according to some embodiments are discussed below. In some embodiments, sports garment 10 is a shirt 100 as shown, for example, in FIGS. 2-4. In some embodiments, shirt 100 comprises sleeves 102 and a torso region 104. The torso region 104 may include a waist region 103, an abdominal region 105, and a breast region 106, as shown in FIG. 3. Torso region 104 may also include a back region 108 and a shoulder blade region 109, as shown in FIG. 4. Any of the features of sports garment 10 discussed above may apply to shirt 100. In some embodiments, shirt 100 may include several zones, and each zone may be configured to contour the body, constrict the muscles to support motion, or provide breathability to the garment. In some embodiments, an upper back motion-supporting compression zone bisects an abdominal body-shaping compression zone at a back of the torso.

Figure 2:
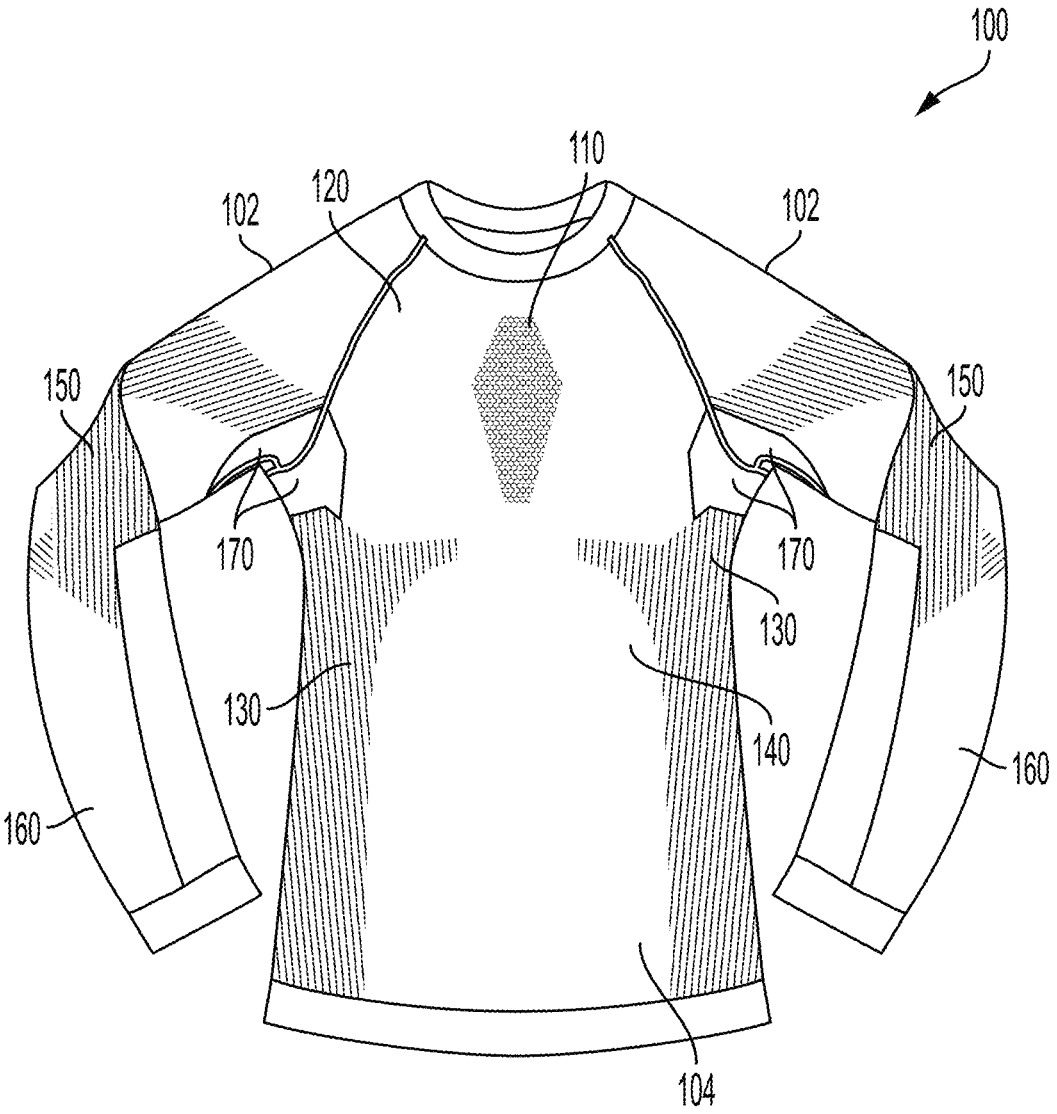
FIG. 2 illustrates a front view of a sports garment according to some embodiments.

For example, shirt 100 may include a first zone 110, a second zone 120, a third zone 130, a fourth zone 140, a fifth zone 150, a sixth zone 160, and a seventh zone 170, as shown in FIG. 2. In some embodiments, shirt 100 may also include an eighth zone 180, a ninth zone 190, and a tenth zone 1000, as shown in FIG. 4. Additional zones, fewer zones, or different zones may be included, depending on the design of the shirt 100.

In some embodiments, first zone 110, third zone 130, and tenth zone 1000 are body-shaping compression zones 30, as discussed above with respect to sports garment 10. In some embodiments, the body-shaping zones (e.g., first zone 110, third zone 130, and tenth zone 1000) are located on torso region 104 of shirt 100. In some embodiments, first zone 110, third zone 130, and tenth zone 1000 are located on areas of shirt 100 that correspond to the abdominal region 105, the waist region 103, the breast region 106, or the shoulder blade region 109 of the wearer. First zone 110, third zone 130, and tenth zone 1000 may be configured to shape the chest, waist, and shoulder blade areas of the wearer. For example, as shown in FIG. 3, first zone 110 and third zone 130 may be configured to contour breast region 106 as well as the waist 103 of the wearer. For example, first zone 110 may be configured to provide a breast lift by applying a compressive force in breast region 106. In some embodiments, shirt 100 may further include ruching 112 extending from first zone 110 to further flatter breast region 106. Third zone 130 may be configured to produce a slimming visual appearance at the abdominal region 105 and the waist region 103 by applying compressive forces. Tenth zone 1000 may be configured to apply compressive forces at shoulder blade region 109 to hide fatty deposits located at shoulder blade region 109. Other shaping and contouring may also be used in some embodiments.

In some embodiments, fifth zone 150, sixth zone 160, and eighth zone 180 are motion-supporting compression zones 20, as discussed above with respect to sports garment 10. In some embodiments, the motion-supporting zones (e.g., fifth zone 150, sixth zone 160, and eighth zone 180) are located on areas of shirt 100 which correspond to the elbow, the back, or the arm of the wearer. In some embodiments, fifth zone 150 and sixth zone 160 are located on sleeves 102. In some embodiments, fifth zone 150 is configured to support the motion of the wearer's shoulder and/or elbow. In some embodiments, sixth zone 160 is configured to support the motion of the wearer's elbow and/or lower arm. For example, fifth zone 150 and sixth zone 160 may apply a compressive force that supports the wearer's motions. In some embodiments, eighth zone 180 is located on back region 108 and is configured to support the muscles and the motion of the wearer (e.g., the back muscles, or movement of the shoulder, etc.). For example, eighth zone 180 may apply a compressive force that supports the wearer's motions.

In some embodiments, the compressive forces applied to the body by the first and third zones 110, 130 are different from the compressive forces applied by the fifth and sixth zones 150, 160. Each of the forces applied by the various zones may be optimized to either contour the body or support motion, depending on the intended function of the zone. For example, a greater compressive force may be desirable in motion-supporting zones than in the body shaping zones, or vice versa. In some embodiments, the compressive force of each zone may be customized (e.g., to form low compression zones, medium compression zones, high compression zones, and/or extra high compression zones), as discussed below with respect to FIGS. 9A-17B.

In some embodiments, second zone 120, fourth zone 140, seventh zone 170, and ninth zone 190 are ventilation zones 40, as discussed above with respect to sports garment 10. Second zone 120, fourth zone 140, seventh zone 170, and ninth zone 190 may be configured to provide breathability to shirt 100. These zones may be located in regions of shirt 100 that correspond to areas of the body that tend to produce sweat, for example the stomach, back, and underarms. In some embodiments, second zone 120, fourth zone 140, seventh zone 170, and/or ninth zone 190 may be a mesh to provide breathability. Breathability may be provided in other ways. For example, multiple textile areas may be bonded together in a way that facilitates breathability, such as through dot bonding.

In some embodiments, the sports garment 10 may be a pair of pants 200 as shown, for example, in FIGS. 5-8. In some embodiments, pants 200 comprises pant legs 202, waist band 204, knee region 206, and buttocks region 208. Any of the features of sports garment 10 discussed above may apply to pants 200. In some embodiments, pants 200 may include several zones, which may be similar to the zones included on shirt 100. Each zone may be configured to contour the body, constrict the muscles to support motion, or provide breathability to the garment.

For example, pants 200 may include a first zone 210, a second zone 220, a third zone 230, a fourth zone 240, a fifth zone 250, a sixth zone 260, and a seventh zone 270, as shown in FIGS. 5-8. Additional zones, fewer zones, or different zones may be included, depending on the design of the pants 200.

Figure 5:
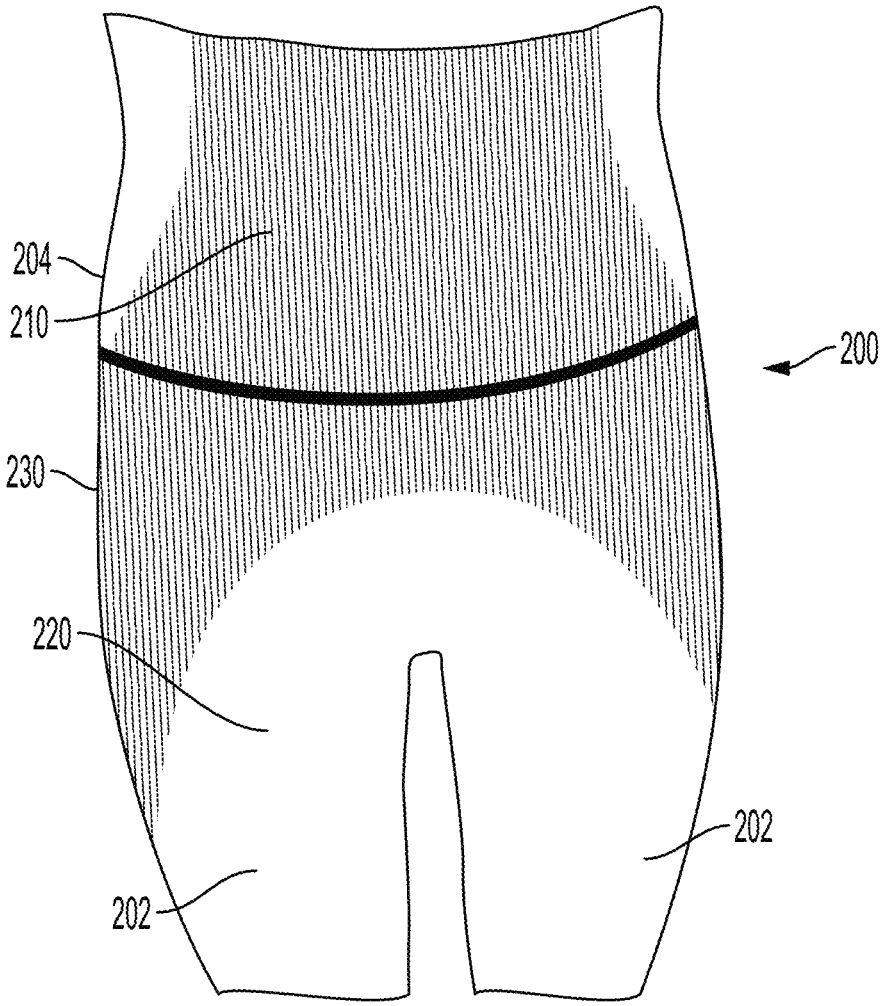
FIG. 5 illustrates a front view of a portion of a sports garment according to some embodiments.
Figure 6:
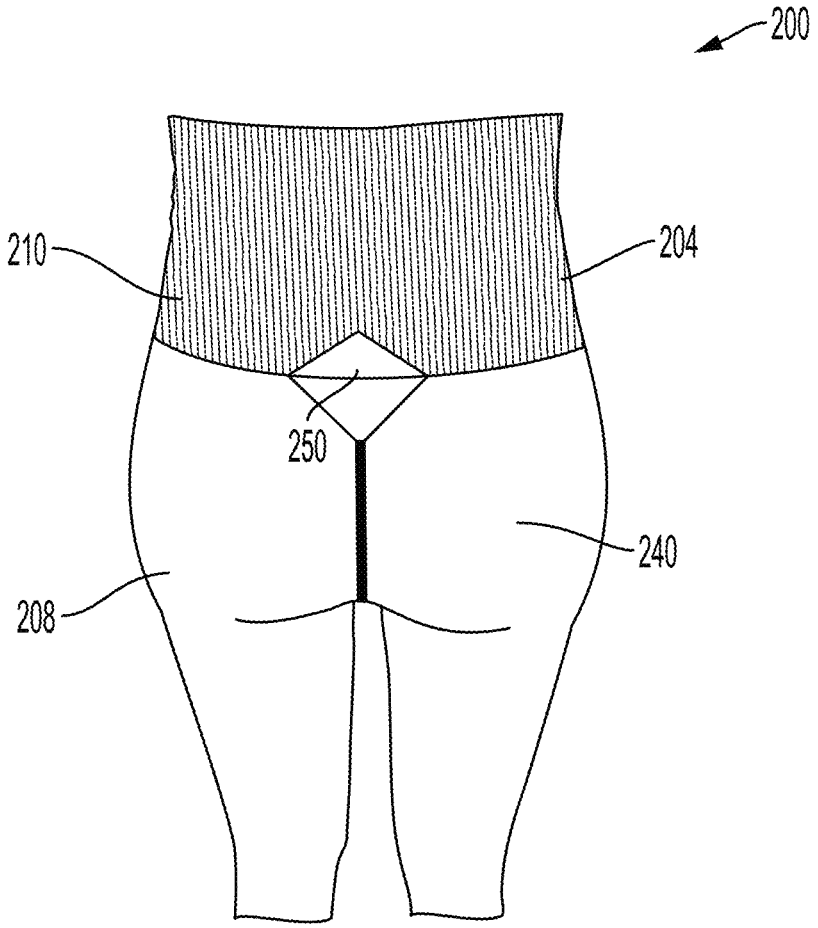
FIG. 6 illustrates a rear view of a portion of a sports garment according to some embodiments.
Figure 7:
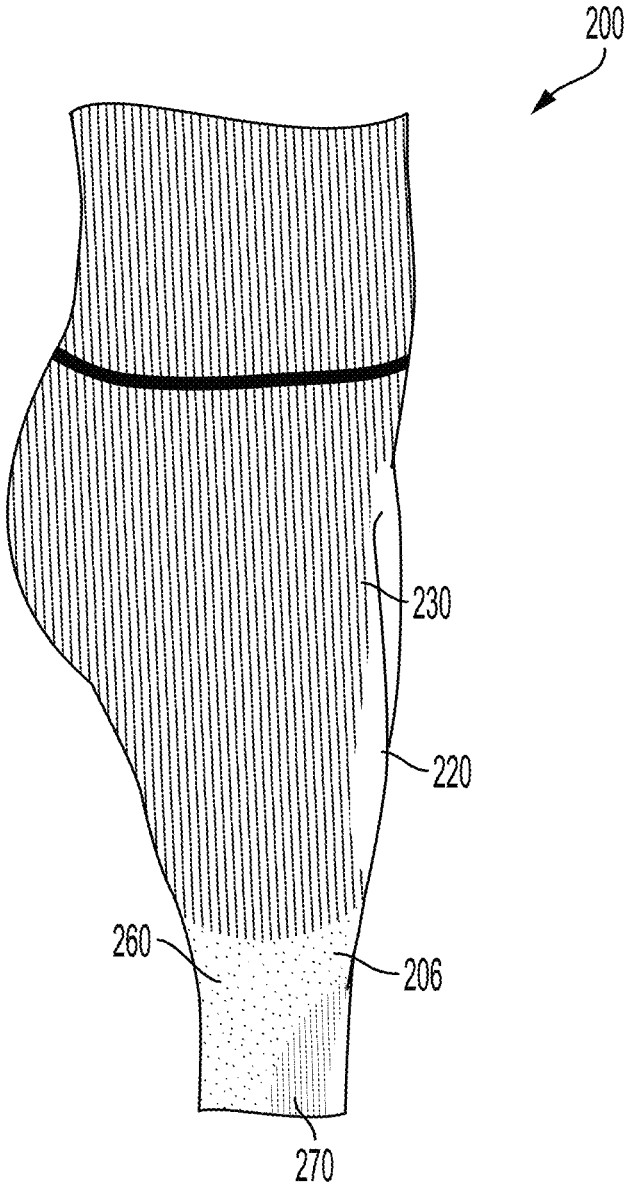
FIG. 7 illustrates a side view of a portion of a sports garment according to some embodiments.
Figure 8:
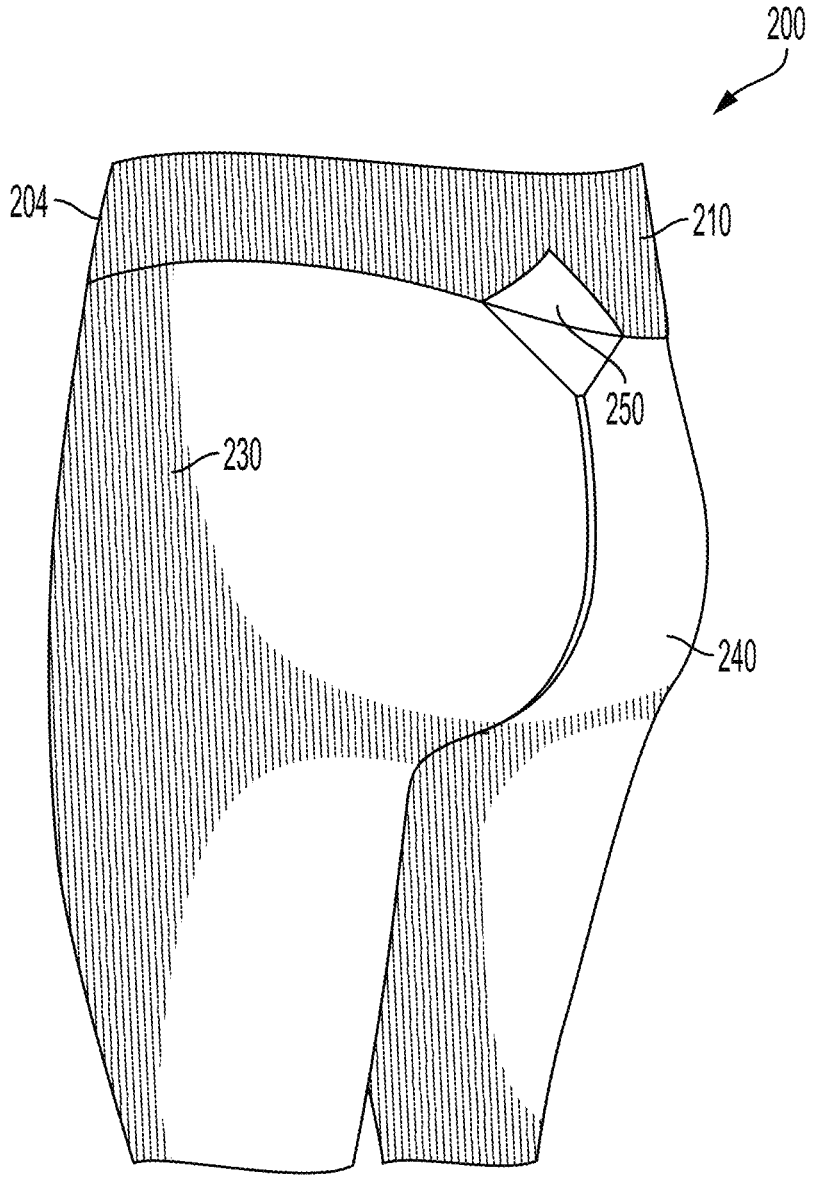
FIG. 8 illustrates a rear perspective view of a portion of a sports garment according to some embodiments.

In some embodiments, first zone 210, second zone 220, third zone 230, and fourth zone 250 are body-shaping compression zones 30, as discussed above with respect to sports garment 10. In some embodiments, the body-shaping zones (e.g., first zone 210, second zone 220, third zone 230, and fourth zone 240) are located on areas of pants 200 that correspond to the waist, thighs, and buttocks of the wearer. In some embodiments, the body-shaping zones are located on areas of pants 200 which correspond to the waist region, the gluteal region, the inner thigh region, the inner knee region, or the outer thigh region of the wearer. First zone 210, second zone 220, third zone 230, and fourth zone 240 may be configured to shape the waist, thighs, and buttocks of the wearer. For example, as shown in FIGS. 5 and 6, first zone 210 may be located on waist band 204 and is configured to apply a compressive force to provide a slimming appearance of the wearer's waist. Second zone 220 and third zone 230 may be located on pant legs 202 of pants 200, as shown in FIG. 5. Second zone 220 may be disposed at a front of the thigh and/or at the inner thigh and third zone 230 may be disposed at a side of the thigh (e.g., the outer thigh). In some embodiments, second zone 220 and third zone 230 are configured to apply a compressive force to shape the wearer's thighs. For example, third zone 230 may be configured to smooth the outer thigh region of the wearer in order to create a flattering shape of the lower body. In some embodiments, fourth zone 240 is disposed at buttocks region 208 and may extend from buttocks region 208 down pant legs 202 as shown, for example, in FIGS. 6 and 8. Fourth zone 240 may be configured to shape the wearer's buttocks by applying a compressive force at the buttocks region 208. For example, as shown in FIG. 8, fourth zone 240 may be configured to lift the gluteal region of the wearer. Other shaping and contouring may also be used in some embodiments.

In some embodiments, sixth zone 260 and seventh zone 270 are motion-supporting compression zones 20, as discussed above with respect to sports garment 10. In some embodiments, motion-supporting zones (e.g., sixth zone 260 and seventh zone 270) are located on areas of pants 200 which correspond to the knee or the lower leg of the wearer, as shown, for example, in FIG. 7. In some embodiments, sixth zone 260 is located on knee region 206. Sixth zone 260 may be configured to support the motion of the wearer's knee. For example, sixth zone 260 may apply a compressive force that supports the wearer's motion. For example, sixth zone 260 may support the knee motion of the wearer and improve blood flow during exercise to ensure that the knee remains warm and flexible, which may aid in avoiding injury.

In some embodiments, seventh zone 270 is located around a lower region of pant legs 202 and is configured to support the muscles and the motion of the wearer at the lower leg. For example, seventh zone 270 may apply a compressive force that supports the wearer's motions. In some embodiments, third zone 230 is alternatively configured to support the muscles and the motion of the wearer instead of contouring the thighs.

Similar to shirt 100, the compressive forces applied by each of the zones of pants 200 configured to shape the body may be different from the compressive forces applied by each of the zones of pants 200 configured to provide motion support. The compressive forces applied by each of the zones may also be different from each of the other zones.

Also similar to shirt 100, pants 200 may include zones configured to provide breathability. In some embodiments, fifth zone 250 is a ventilation zone 40, as discussed above with respect to sports garment 10. For example, fifth zone 250 may be located on the back of waist band 204. In some embodiments, fifth zone 250 may be configured to provide breathability to the lower back of the wearer.

Each of the zones included on both shirt 100 and pants 200 may be shaped and dimensioned to maximize their impacts. For example, the tapered shape of third zone 130 on shirt 100 may cause the waist of the wearer to be slimmed, accordingly. Similarly, the curved shapes of first zone 110 on shirt 100 and fourth zone 240 on pants 200 may compliment and contour the breasts and buttocks of the wearer.

Various construction methods may be used to form sports garments 10, 100, 200, including for example, knitting, weaving, cut and sew, or placed engineered methods of construction.

For example, the sports garments 10, 100, 200 described herein may be formed by knitting (e.g., by circular knitting). In some embodiments, the knitting process may form the entire sports garment 10, 100, 200. For example, the entire sports garment 10, 100, 200 may be made from a single textile. Thus, the various zones may be coupled together seamlessly (e.g., the zones are coupled by the knitting process).

In some embodiments, sports garments 10, 100, 200 comprise an engineered knit fabric. Thus, the various zones may be formed in the textile by modifying characteristics of the knitting. In some embodiments, the characteristics may be, for example, the type of yarn, the type of knitting stich, or a density of the knit. These characteristics may determine the resulting configuration of the zones. For example, the compressive force of the zones discussed herein may be determined by the type of yarn, the type of knitting or knitting stitches, the density of the knit, the tension of the yarn, ribbing structures within a fabric, fabric construction, or a combination of the foregoing characteristics. In some embodiments, the compressive force for a particular zone may be achieved by adjusting the tension of the yarn. In some embodiments, the compressive force for a particular zone may be engineered into the textile by altering a rib structure. For example, the textile may use alternating single jersey and Milano rib structures. In some embodiments, the compressive force for a particular zone may be achieved by using a tunnel construction (also referred to as a tubular construction), in which two layers of fabric are stacked to form a tunnel (e.g., the layers are not connected to each other at an inner portion). A tunnel construction may provide a higher compression due to having two layers of fabric.

In some embodiments, the sports garment can be manufactured by knitting a textile. During the knitting process, a first characteristic of the knitting may be modified to form a motion-supporting compression zone in the textile. In some embodiments, the first characteristic comprises at least one of a type of yarn, a type of knitting stitch, or a density of the knit. Similarly, a second characteristic of the knitting may be modified to form a body-shaping compression zone in the textile. In some embodiments, the knitting comprises circular knitting. In some embodiments, the first characteristic is a different characteristic than the second characteristic. However, the first characteristic and the second characteristic may be the same characteristic, but a different value (e.g., the first and second characteristic are a density of the knit, but the densities are a different value). Modifying these characteristics may impart a certain compressive force commensurate with the intended function of the zone. This may allow for customization of the garments without altering the overall design.

In some embodiments, the zones may be created with a circular knitting process. For example, isolated areas of the tubular knitted textile formed by a circular knitting process may provide a different compressive force than surrounding or adjacent areas. In some embodiments, the isolated areas may be horizontally engineered into the tubular knitted textile. For example, elastane may be included in an isolated area that does not extend the full width of the tube. Alternatively, the structure density of an isolated area that does not extend the full width of the tube may be different than a surrounding or adjacent area. In some embodiments, elastane and a particular structure density may be used in an isolated area.

In some embodiments, the sports garments 10, 100, 200 described herein may be formed with a cut and sew construction method. For example, in some embodiments, the sports garments 10, 100, 200 comprise multiple textiles subsequently coupled together. One or more of the zones may be made with a separate textile and the separate textiles may be coupled together by sewing. Other techniques for coupling multiple textiles together may be used. For example, in some embodiments, one or more of the zones may be made with a separate textile and the separate textiles may be bonded together. For example, the motion-supporting zones may be made from a first textile, while the moisture-wicking zones may be made from a second textile. In some embodiments, where multiple textiles are used to create the garment, each of the textiles is coupled together seamlessly. In some embodiments, the characteristics of the various zones (e.g., body shaping, motion supporting, and/or ventilation) may be influenced by the bonding technique. For example, dot bonding may be used to join multiple textiles. The pattern and/or size of the dots for bonding may influence the characteristics of the zones to accomplish desired compression. Laminate textiles (i.e., layered textiles) may also be used to influence the characteristics of the zones to accomplish desired compression. For example, more or fewer layers may be used to achieve the desired compression.

Regardless of the textile used, the textile may be opaque such that the garments may be worn on their own, unlike conventional shapewear. However, although the textile may be opaque, some of the zones within the garments may be sheer, for example mesh regions, for both aesthetic purposes and to provide breathability.

Although the sports garments described above relate to shirts and pairs of pants, the zones described herein may be applied to any article of clothing, for example a sports bra, socks, shorts, jackets, underwear, gloves, or any other article of clothing. Additional exemplary sports garments are shown, for example, in FIGS. 9A-17B. Any of the features of sports garments 10, 100, 200 discussed above may apply to the sports garments shown in FIGS. 9A-17B. For example, the sports garments shown in FIGS. 9A-17B include one or more motion-supporting compression zones 20, one or more body-shaping compression zones 30, and/or one or more ventilation zones 40. The sports garments shown in FIGS. 9A-17B provide exemplary amounts of compression (e.g., low compression 350, medium compression 352, high compression, 354, and extra high compression 356) for various zones and exemplary knitting structures (e.g., small hole mesh 360, large hole mesh 362, tubular construction 370, half Milano stitch 374, piquet stitch 378) for various zones.

Figure 9B:
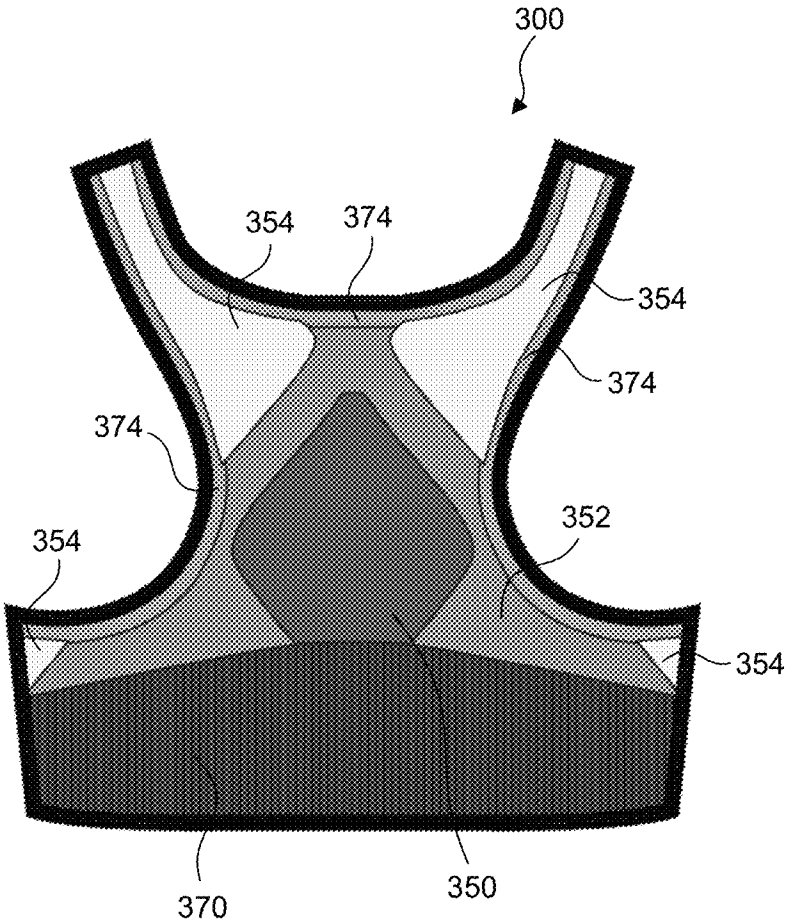
FIG. 9B illustrates a rear view of a sports garment according to some embodiments.
Figure 9A:
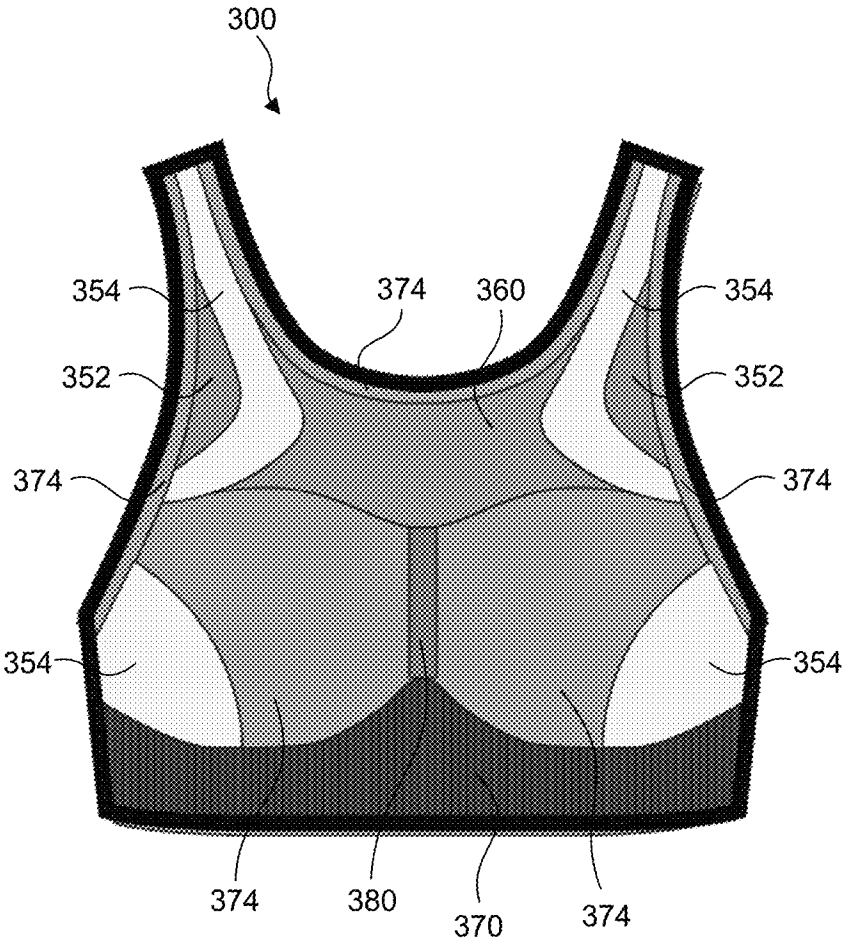
FIG. 9A illustrates a front view of a sports garment according to some embodiments.

In some embodiments, the sports garment is a bra 300, as shown, for example, in FIGS. 9A and 9B. Bra 300 may include zones of low compression 350, medium compression 352, and/or high compression 354; zones of small hole mesh 360, tubular construction 370, and/or half Milano stitch 374; and a breast shaping/separation zone 380.

Bra 300 may include four zones of high compression 354. In some embodiments, bra 300 includes two zones of high compression 354 on an outer, lower portion of the breast region of bra 300 and extending to the back of bra 300. These zones of high compression 354 may be a body-shaping compression zone 30 (e.g., to lift the breasts). In some embodiments, bra 300 includes two zones of high compression 354 extending from a front portion of bra 300 (e.g., above a breast region of bra 300), along the bra strap to an upper, back portion of bra 300, as shown in FIGS. 9A and 9B. These zones of high compression 354 may be a motion-supporting compression zone 20.

Bra 300 may include two front zones of medium compression 352 (see FIG. 9A). For example, zones of medium compression 352 may be disposed adjacent to zones of high compression 354 just below the bra strap. Bra 300 may include a back zone of medium compression 352 (see FIG. 9B). This zone of medium compression 352 may generally form a triangular outline that extends across the width of bra 300 and extends from a top central portion of bra 300, as shown in FIG. 9B. In some embodiments, a zone of low compression 350 may be disposed within this back zone of medium compression 352. The zone of low compression 350 may approximately form a diamond shape. In some embodiments, the back zone of medium compression 352 and the zone of low compression 350 may be a motion-supporting compression zone 20 and/or a body-shaping compression zone 30.

In some embodiments, a zone of tubular construction 370 is disposed around a lower portion of bra 300. In some embodiments, the tubular construction 370 comprises two layers of material, as discussed above. In some embodiments, tubular construction 370 may be elastic. In some embodiments, zones of half Milano stitch 374 are disposed at a breast region of bra 300. Half Milano stitch 374 may provide an opaque textile so that bra 300 is not see-through at the breast region. In some embodiments, the zones of half Milano stitch 374 disposed at the breast region are made with 3-D knitting, which may improve the fit of bra 300 at the breast region. In some embodiments, bra 300 includes zones of half Milano stitch 374 along edges of the bra straps. For example, FIGS. 9A and 9B show a zone of half Milano stitch 374 around the neckline of bra 300 and zones of half Milano stitch 374 around the arm holes of bra 300. In some embodiments, bra 300 includes a zone of small hole mesh 360 disposed above the breast region at a front, central portion of bra 300. For example, the zone of small hole mesh 360 may extend between the bra straps. The zone of small hole mesh 360 may be a ventilation zone 40.

In some embodiments, a breast shaping/separation zone 380 is also disposed at a breast region of bra 300. In some embodiments, breast shaping/separation zone 380 is disposed between two zones of half Milano stitch 374, as shown in FIG. 9A. Breast shaping/separation zone 380 may shape and separate the two breasts. In some embodiments, breast shaping/separation zone 380 comprises a ruching.

Figure 10B:
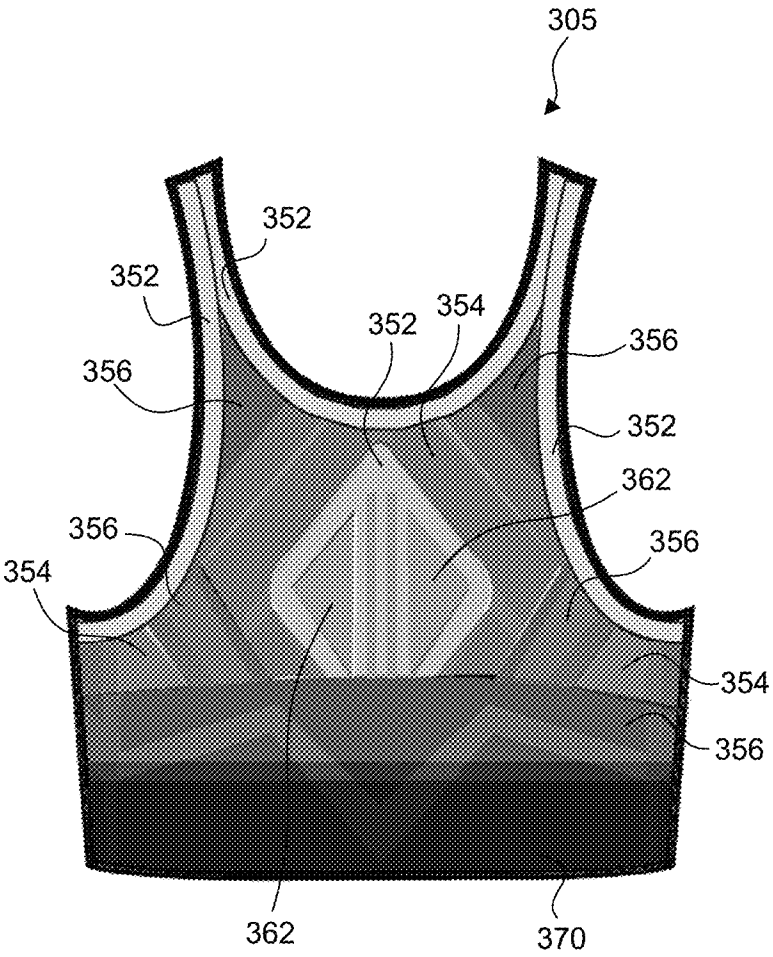
FIG. 10B illustrates a rear view of a sports garment according to some embodiments.
Figure 10A:
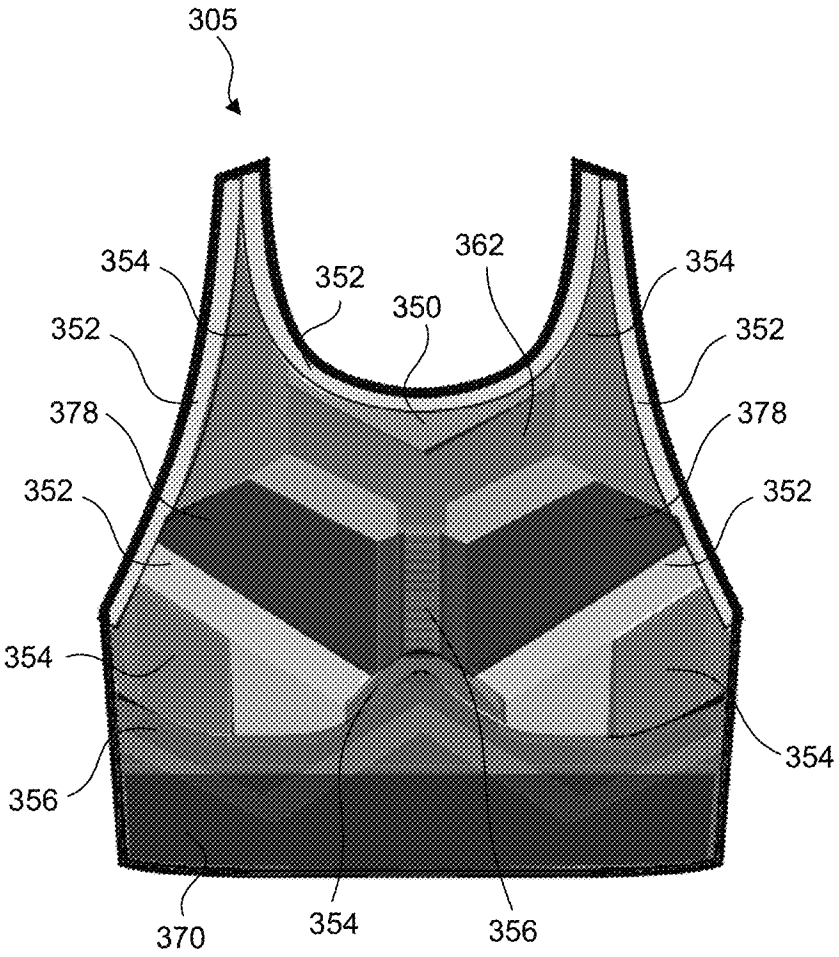
FIG. 10A illustrates a front view of a sports garment according to some embodiments.
Figure 11B:
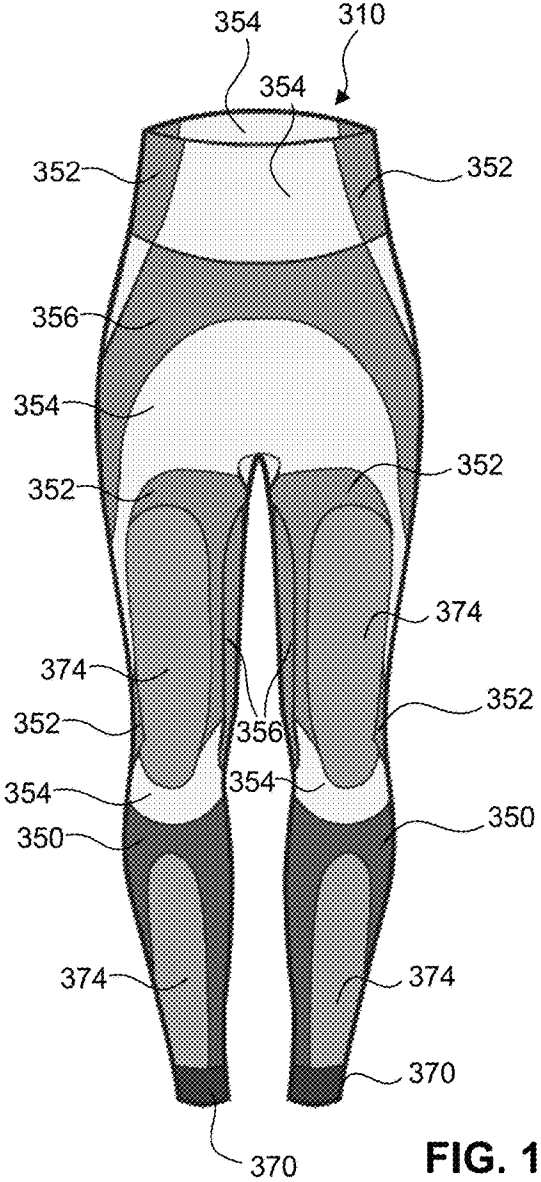
FIG. 11B illustrates a front view of a sports garment according to some embodiments.
Figure 11A:
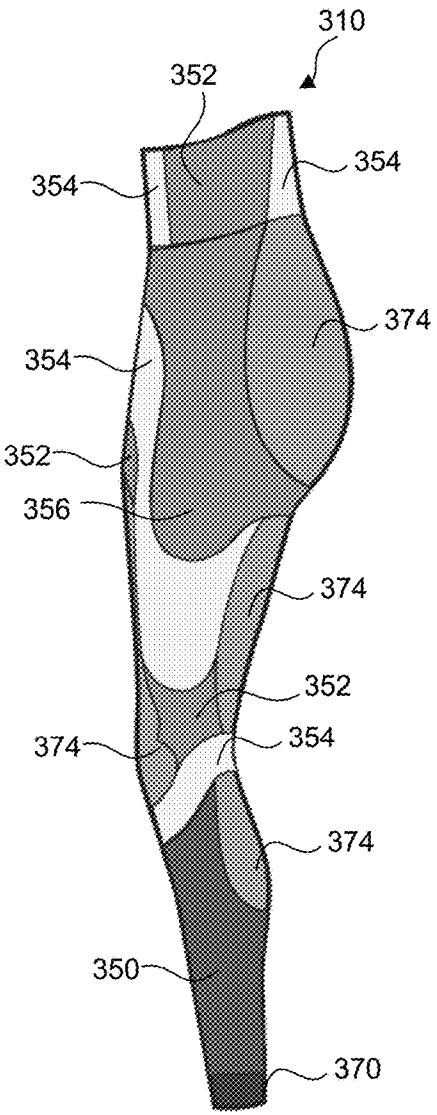
FIG. 11A illustrates a side view of a sports garment according to some embodiments.
Figure 11D:
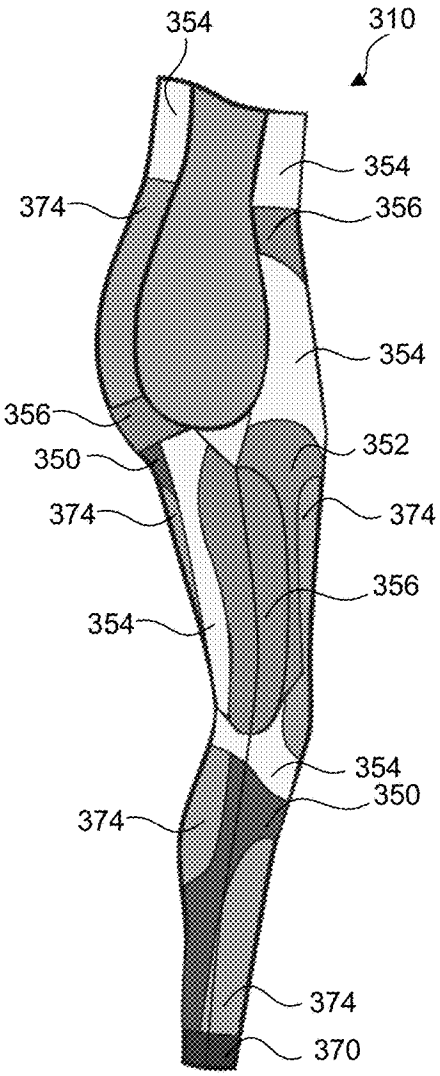
FIG. 11D illustrates an inner view of a leg of a sports garment according to some embodiments.
Figure 11C:
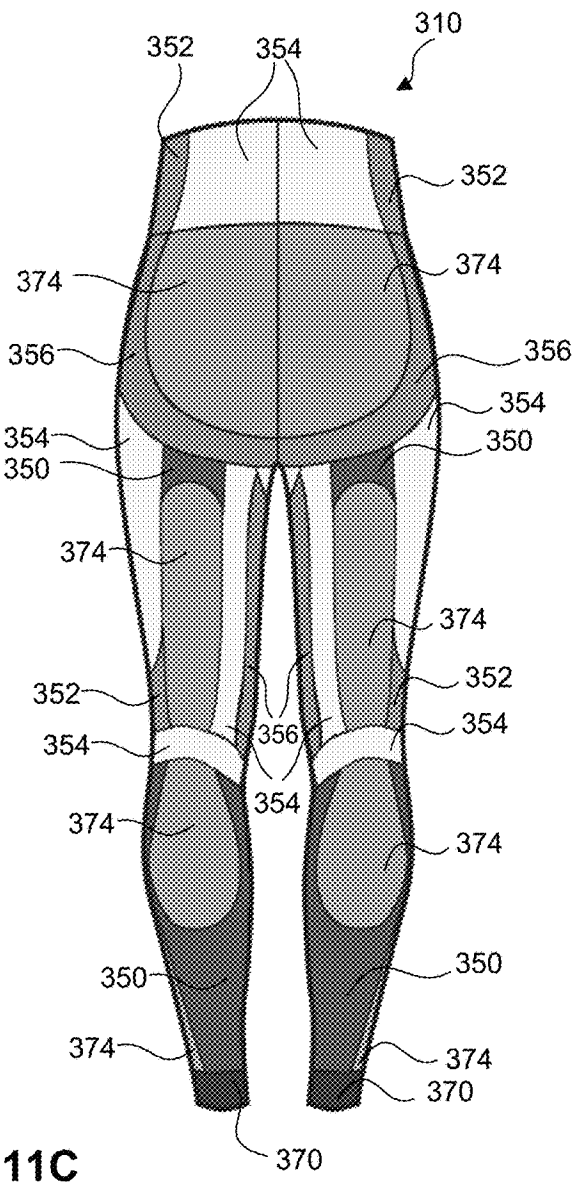
FIG. 11C illustrates a rear view of a sports garment according to some embodiments.

In some embodiments, the sports garment is a bra 305, as shown, for example, in FIGS. 10A and 10B. Bra 305 may include zones of low compression 350, medium compression 352, high compression 354, and/or extra high compression 356; and zones of large hole mesh 362, tubular construction 370, and/or piquet stitch 378.

Bra 305 may include one or more zones of extra high compression 356. For example, bra 305 may include a zone of extra high compression 356 that extends circumferentially around bra 305 just below a breast region. In some embodiments, this zone of extra high compression 356 is a body-shaping compression zone 30 (e.g., to lift the breasts). In some embodiments, bra 305 includes a rectangular zone of extra high compression 356 disposed in the breast region between the two breasts. In some embodiments, this zone of extra high compression 356 is a body-shaping compression zone 30. For example, this zone of extra high compression 356 may shape and separate the two breasts. In some embodiments, this zone of extra high compression 356 comprises ruching. In some embodiments, bra 305 includes zones of extra high compression 356 in a back portion of bra 305. For example, the back zones of extra high compression 356 may form a diamond-like shape that surrounds other zones of lower compression (e.g., zones of high compression 354 or medium compression 352).

Bra 305 may include one or more zones of high compression 354. In some embodiments, bra 305 includes two zones of high compression 354 on an outer, lower portion of the breast region of bra 305 and extending to the back of bra 305. In some embodiments, bra 305 includes a zone of high compression 354 on an inner, lower portion of the breast region of bra 305. These zones of high compression 354 may be a body-shaping compression zone 30 (e.g., to lift the breasts). In some embodiments, bra 305 includes two zones of high compression 354 disposed at a front portion of bra 305 (e.g., above a breast region of bra 305) and extending upwards to for form a portion of the bra strap of bra 305, as shown in FIG. 10A. These zones of high compression 354 may be a motion-supporting compression zone 20. In some embodiments, bra 305 includes a diamond-shaped zone of high compression 354 disposed on a back of bra 305. This diamond-shaped zone of high compression 354 may be surrounded by a zone of extra high compression 356 while also surrounding diamond-shaped zone of medium compression 352.

Bra 305 may include one or more zones of medium compression 352. For example, zones of medium compression 352 may be disposed at a breast region of bra 305, extending from an outer portion of bra 305 to a high compression zone 34 at an inner portion of the breast region. In some embodiments, bra 305 includes zones of medium compression 352 along edges of the bra straps. For example, FIGS. 10A and 10B show a zone of medium compression 352 around the neckline of bra 305 and zones of medium compression 352 around the arm holes of bra 305. In some embodiments, bra 305 includes a diamond-shaped zone of medium compression 352 disposed on a back of bra 305 (e.g., at a central portion). This diamond-shaped zone of medium compression 352 may be surrounded by a zone of high compression 354. In some embodiments, the diamond-shaped zones of extra high compression 356, high compression 354, and medium compression 352 may be a motion-supporting compression zone 20 and/or a body-shaping compression zone 30. In some embodiments, a zone of low compression 350 may be disposed at a top front portion of bra 305 (see FIG. 10A).

In some embodiments, a zone of tubular construction 370 is disposed around a lower portion of bra 305. In some embodiments, the tubular construction 370 comprises two layers of material, as discussed above. In some embodiments, tubular construction 370 may be elastic. In some embodiments, zones of piquet stitch 378 are disposed at a breast region of bra 305 (e.g., above zones of medium compression 352). Piquet stitch 378 may provide an opaque textile so that bra 305 is not see-through at the breast region. In some embodiments, the zones of piquet stitch 378 disposed at the breast region are made with 3-D knitting, which may improve the fit of bra 305 at the breast region. In some embodiments, bra 305 includes a zone of large hole mesh 362 disposed above the breast region at a front, central portion of bra 300 (e.g., above zone of piquet stitch 378 and below zone of low compression 350). In some embodiments, bra 305 includes a zone of large hole mesh 362 at a back, central portion of bra 305 (e.g., within diamond-shaped zone of medium compression 352). The zones of large hole mesh 362 may extend between the bra straps. The zone of large hole mesh 362 may be a ventilation zone 40.

In some embodiments, the sports garment is leggings 310, as shown, for example, in FIGS. 11A-D. Leggings 310 may include zones of low compression 350, medium compression 352, high compression 354, and/or extra high compression 356; and zones of tubular construction 370 and/or half Milano stitch 374.

Leggings 310 may include one or more zones of extra high compression 356. For example, leggings 310 may include a zone of extra high compression 356 that extends from a front waist region (see FIG. 11B), down a side of leggings 310 to just below the buttocks region (see FIG. 11A), around the bottom of buttocks region and up the other side of leggings 310 (see FIG. 11C), and back to the front waist region (see FIG. 11B). In some embodiments, this zone of extra high compression 356 is a body-shaping compression zone 30. For example, this zone of extra high compression 356 may lift the buttocks. In some embodiments, leggings 310 include zones of extra high compression 356 on an inner portion of the thighs of leggings 310 (see FIG. 11D). This zone of extra high compression 356 may extend from a crotch region to a knee region of leggings 310. In some embodiments, this inner thigh zone of extra high compression 356 is a motion-supporting compression zone 20.

Leggings 310 may include one or more zones of high compression 354. In some embodiments, leggings 310 include a zone of high compression 354 that extends circumferentially around the legs of leggings 310 at the knee region (e.g., just below the knee in the front of leggings 310 and behind the knee in the back of leggings 310). In some embodiments, this zone of high compression 354 is a motion-supporting compression zone 20. In some embodiments, leggings 310 include zones of high compression 354 disposed at a back portion of the inner thigh of leggings 310 extending from the buttocks to the knee region of leggings 310. In some embodiments, this zone of high compression 354 is a motion-supporting compression zone 20. In some embodiments, leggings 310 include a zone of high compression 354 that extends across the front of leggings 310 at a crotch region and down both outer thighs toward the knee. In some embodiments, this zone of high compression 354 is a motion-supporting compression zone 20 and/or a body-shaping compression zone 30. For example, the thigh portion of this zone of high compression 354 may support motion of the leg while the front crotch region may shape the lower portion of the torso. In some embodiments, the thigh portion of this zone of high compression 354 also shapes the thigh, thus forming a body-shaping compression zone 30. Leggings 310 may also include zones of high compression 354 on the front and back of a waist region of leggings 310. These zones of high compression 354 may be body-shaping compression zones 30.

Leggings 310 may include one or more zones of medium compression 352. For example, zones of medium compression 352 may be disposed at the sides of the waist region of leggings 310. These zones of medium compression 352 may be body-shaping compression zones 30. In some embodiments, leggings 310 include zones of medium compression 352 just above the knee at an outer portion of the legs (see FIGS. 11A and 11C). These zones of medium compression 352 may be motion-supporting compression zones 20. In some embodiments, leggings 310 include zones of medium compression 352 disposed at a front portion of leggings 310 at a top of the thigh and extending down along a front portion of the inner thigh towards the knee (see FIGS. 11B and 11D). These zones of medium compression 352 may be motion-supporting compression zones 20. Leggings 310 may include one or more zones of low compression 350. For example, zones of low compression 350 may be disposed around a lower portion of the leggings (e.g., around the calf and/or shin). Zones of low compression 350 may also be disposed at a back, upper portion of the thigh.

In some embodiments, a zone of tubular construction 370 is disposed circumferentially around an ankle of leggings 310. In some embodiments, the tubular construction 370 comprises two layers of material, as discussed above. In some embodiments, tubular construction 370 may be elastic. In some embodiments, a zone of half Milano stitch 374 is disposed at a buttocks region of leggings 310. Half Milano stitch 374 may provide an opaque textile so that leggings 310 are not see-through at the buttocks region. In some embodiments, the zone of half Milano stitch 374 at the buttocks region comprises a flatlock stitch to visually separate the buttocks. Zones of half Milano stitch 374 may also be provided at a front of the thigh, a back of the thigh, a calf, and/or a shin of leggings 310.

Figure 12B:
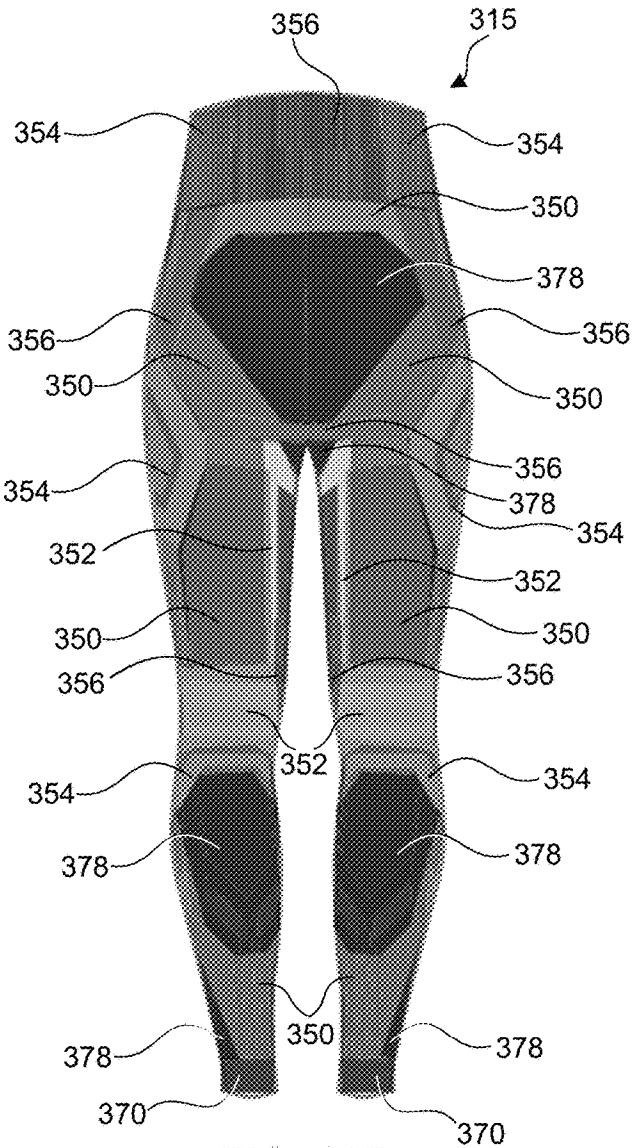
FIG. 12B illustrates a rear view of a sports garment according to some embodiments.
Figure 12A:
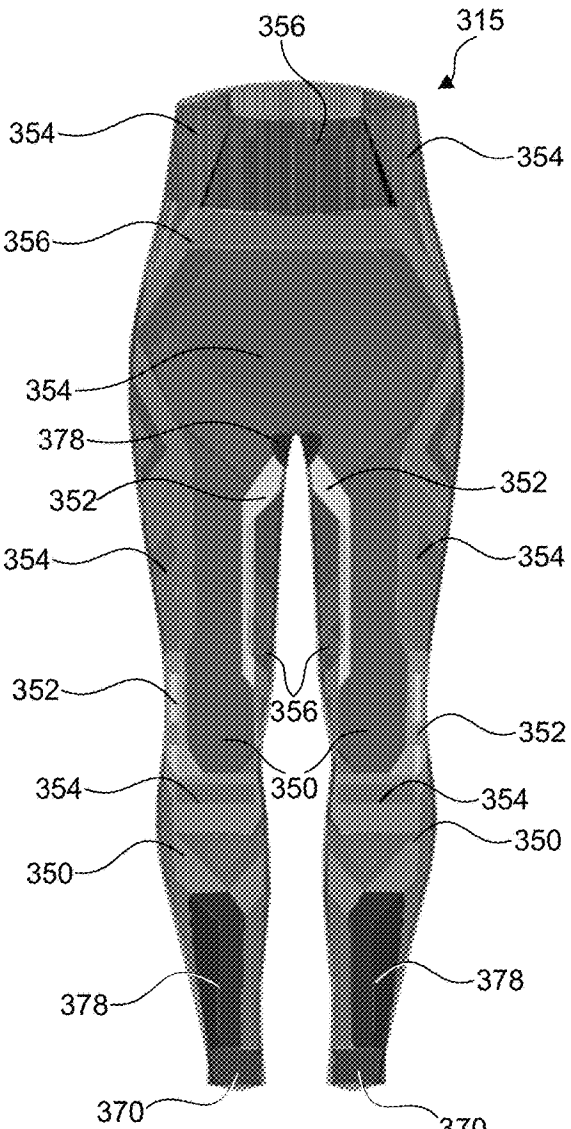
FIG. 12A illustrates a front view of a sports garment according to some embodiments.
Figure 13B:
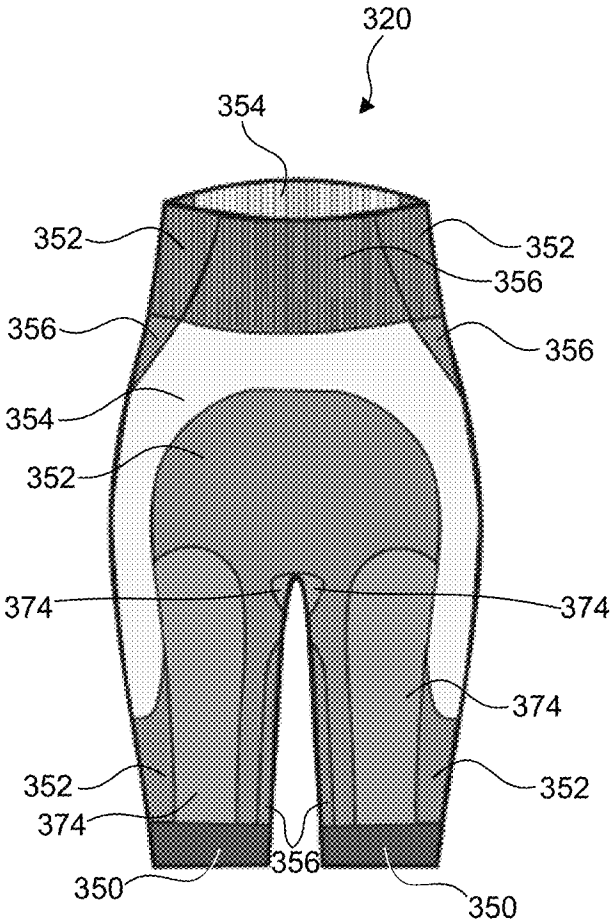
FIG. 13B illustrates a front view of a sports garment according to some embodiments.
Figure 13A:
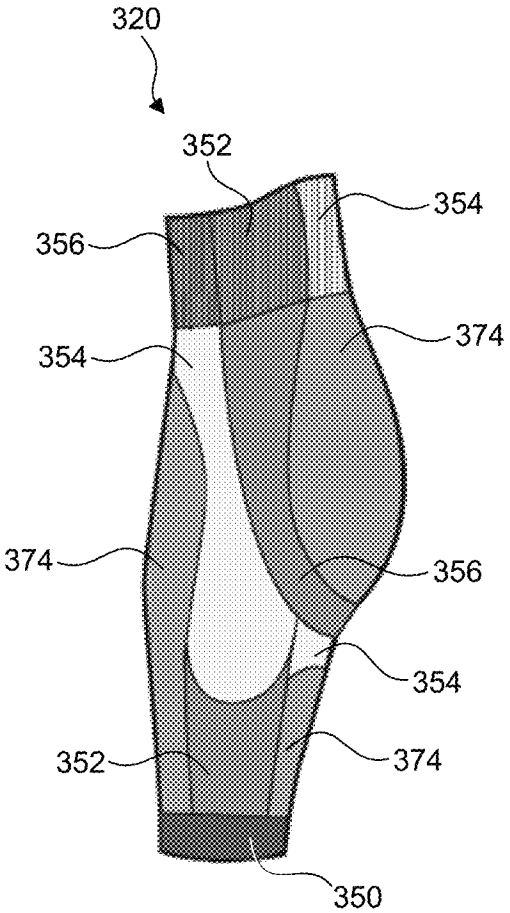
FIG. 13A illustrates a side view of a sports garment according to some embodiments.
Figure 13D:
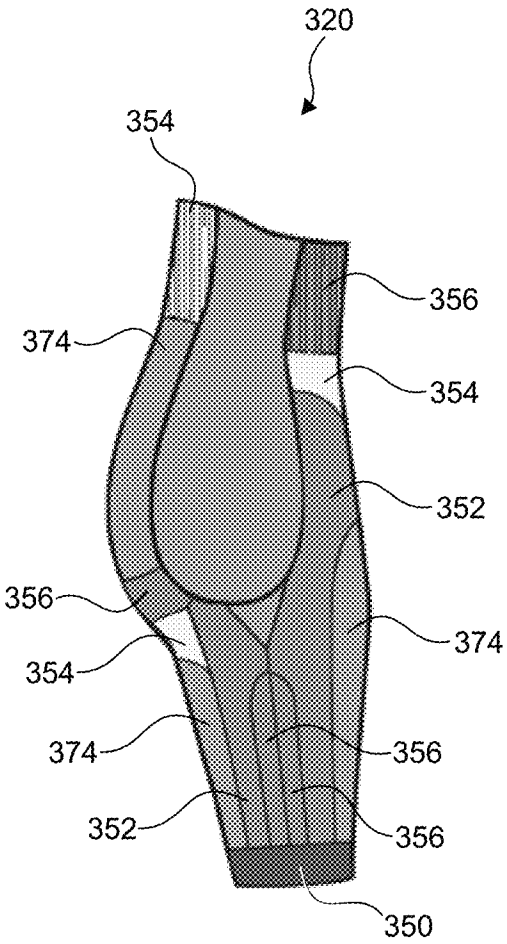
FIG. 13D illustrates an inner view of a leg of a sports garment according to some embodiments.
Figure 13C:
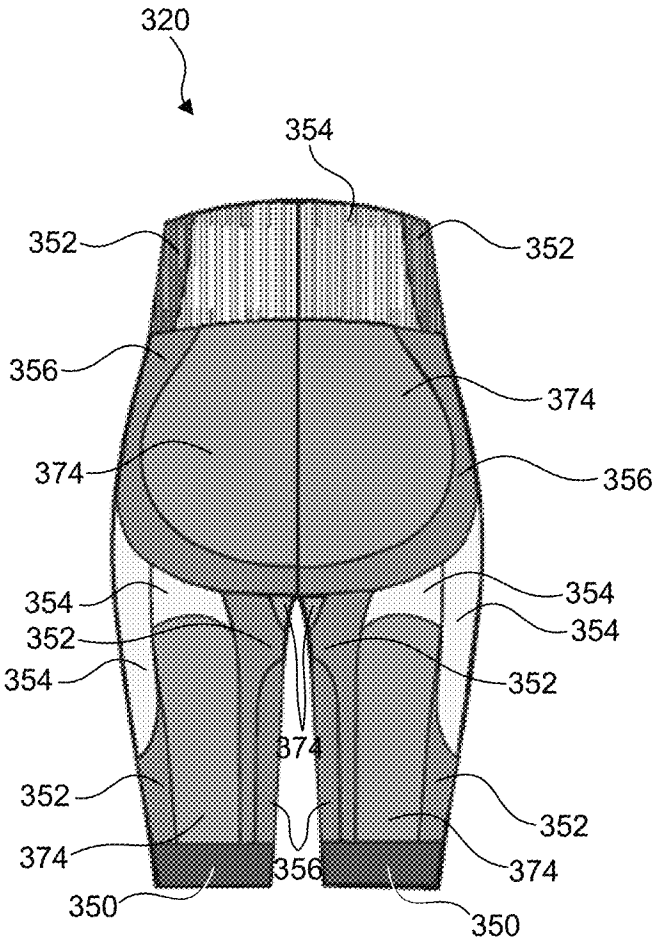
FIG. 13C illustrates a rear view of a sports garment according to some embodiments.

In some embodiments, the sports garment is leggings 315, as shown, for example, in FIGS. 12A and 12B. Leggings 315 may include zones of low compression 350, medium compression 352, high compression 354, and/or extra high compression 356; and zones of tubular construction 370 and/or piquet stitch 378.

Leggings 315 may include one or more zones of extra high compression 356. For example, leggings 315 may include a zone of extra high compression 356 that extends from a front waist region (see FIG. 12A), down both sides of leggings 315 (see FIG. 12A), and around the bottom of buttocks region (see FIG. 12B). In some embodiments, this zone of extra high compression 356 is a body-shaping compression zone 30. For example, this zone of extra high compression 356 may lift the buttocks. In some embodiments, leggings 315 include zones of extra high compression 356 on an inner portion of the thighs of leggings 315. This zone of extra high compression 356 may extend from a crotch region to a knee region of leggings 315. In some embodiments, this inner thigh zone of extra high compression 356 is a motion-supporting compression zone 20. Leggings 315 may also include zones of extra high compression 356 on the front and back of a waist region of leggings 315. These zones of extra high compression 356 may be body-shaping compression zones 30.

Leggings 315 may include one or more zones of high compression 354. In some embodiments, leggings 315 include a zone of high compression 354 that extends circumferentially around the legs of leggings 315 at the knee region (e.g., just below the knee in the front of leggings 315 and behind the knee in the back of leggings 315). In some embodiments, this zone of high compression 354 is a motion-supporting compression zone 20. In some embodiments, leggings 315 include a zone of high compression 354 that extends across the front of leggings 315 at a crotch region. In some embodiments, this zone of high compression 354 is a body-shaping compression zone 30. In some embodiments, leggings 315 include zones of high compression 354 disposed along an outer thigh of the leggings 315. These zones of high compression 354 may extend from the buttocks to the knee of leggings 315. In some embodiments, these zones of high compression 354 extend for a longer distance along a back portion of the outer thigh than along a front portion of the outer thigh. These zones of high compression 354 may be a motion-supporting compression zone 20 or a body-shaping compression zone 30. In some embodiments, leggings 315 include zones of high compression 354 disposed at the sides of the waist region of leggings 315. These zones of high compression 354 may be body-shaping compression zones 30.

Leggings 315 may include one or more zones of medium compression 352. For example, zones of medium compression 352 may be disposed just above the knee at an outer portion and a back portion of the legs. These zones of medium compression 352 may be motion-supporting compression zones 20. In some embodiments, leggings 315 include zones of medium compression 352 on an inner portion of the thighs of leggings 315. This zone of medium compression 352 may partially surround the zone of extra high compression 356 disposed on an inner thigh of leggings 315. For example, this zone of medium compression 352 may extend from a crotch region to a knee region of leggings 315 on both a front portion of the inner thigh and a back portion of the inner thigh. In some embodiments, this inner thigh zone of medium compression 352 is a motion-supporting compression zone 20. Leggings 310 may include one or more zones of low compression 350. For example, zones of low compression 350 may be disposed around a lower portion of the leggings (e.g., around the calf and/or shin). Zones of low compression 350 may also be disposed at a buttocks region of leggings 315 (e.g., around a zone of piquet stitch 378). These zones may be body-shaping zones 30. Zones of low compression 350 may also be disposed at a front of thigh, and/or at a back of thigh. These zones may be motion-supporting zones 20.

In some embodiments, a zone of tubular construction 370 is disposed circumferentially around an ankle of leggings 315. In some embodiments, the tubular construction 370 comprises two layers of material, as discussed above. In some embodiments, tubular construction 370 may be elastic. In some embodiments, a zone of piquet stitch 378 is disposed at a buttocks region of leggings 315. Piquet stitch 378 may provide an opaque textile so that leggings 315 are not see-through at the buttocks region. In some embodiments, the zone of piquet stitch 378 at the buttocks region comprises a flatlock stitch to visually separate the buttocks. Zones of piquet stitch 378 may also be provided at a crotch region, a calf, and/or a shin of leggings 315.

In some embodiments, the sports garment is shorts 320, as shown, for example, in FIGS. 13A-D. Shorts 320 may include zones of low compression 350, medium compression 352, high compression 354, and/or extra high compression 356; and zones of half Milano stitch 374.

Shorts 320 may include one or more zones of extra high compression 356. For example, shorts 320 may include a zone of extra high compression 356 that extends around the bottom of a buttocks region and up both sides of the buttocks to a waist region of the shorts 320 (see FIGS. 13A and 13C). In some embodiments, this zone of extra high compression 356 is a body-shaping compression zone 30. For example, this zone of extra high compression 356 may lift the buttocks. In some embodiments, shorts 320 includes zones of extra high compression 356 on an inner portion of the thighs of shorts 320 (see FIGS. 13B-D). In some embodiments, this inner thigh zone of extra high compression 356 is a motion-supporting compression zone 20. Shorts 320 may also include a zone of extra high compression 356 on the front of a waist region of shorts 320. This zone of extra high compression 356 may be a body-shaping compression zone 30.

Shorts 320 may include one or more zones of high compression 354. For example, shorts 320 may include a zone of high compression 354 that extends from a front waist region (see FIG. 13B), down both sides of shorts 320 to just below the buttocks region (see FIG. 13A), and around the back of shorts 320 just below buttocks region (e.g., below the zone of extra high compression 356) (see FIG. 13C). In some embodiments, this zone of high compression 354 is a body-shaping compression zone 30. This zone of high compression 354 may also be a motion-supporting zone 20 (e.g., at an outer thigh of shorts 320). Shorts 320 may also include a zone of high compression 354 on the back of a waist region of shorts 320. This zone of high compression 354 may be a body-shaping compression zone 30.

Shorts 320 may include one or more zones of medium compression 352. For example, zones of medium compression 352 may be disposed at the sides of the waist region of shorts 320. These zones of medium compression 352 may be body-shaping compression zones 30. In some embodiments, shorts 320 include zones of medium compression 352 just above the knee at an outer portion of the legs (see FIGS. 13A-C). These zones of medium compression 352 may be motion-supporting compression zones 20. In some embodiments, shorts 320 include a zone of medium compression 352 that extends across the front of shorts 320 at a crotch region and down both inner thighs toward the knee. This zone of medium compression 352 may partially surround the zone of extra high compression 356 disposed on an inner thigh of shorts 320. For example, this zone of medium compression 352 may extend from a crotch region to a knee region of shorts 320 on both a front portion of the inner thigh and a back portion of the inner thigh (see FIG. 13D). In some embodiments, this zone of medium compression 352 is a motion-supporting compression zone 20 and/or a body-shaping compression zone 30. For example, the inner thigh portion of this zone of high compression 354 may support motion of the leg while the front crotch region may shape the lower portion of the torso. In some embodiments, the inner thigh portion of this zone of high compression 354 also shapes the thigh, thus forming a body-shaping compression zone 30. Shorts 320 may include one or more zones of low compression 350. For example, zones of low compression 350 may be disposed circumferentially around a lowest portion of the shorts 320 (e.g., at or near the knee).

In some embodiments, a zone of half Milano stitch 374 is disposed at a buttocks region of shorts 320. Half Milano stitch 374 may provide an opaque textile so that shorts 320 are not see-through at the buttocks region. In some embodiments, the zone of half Milano stitch 374 at the buttocks region comprises a flatlock stitch to visually separate the buttocks. Zones of half Milano stitch 374 may also be provided at a crotch region, a front of the thigh, and/or a back of the thigh.

Figure 14B:
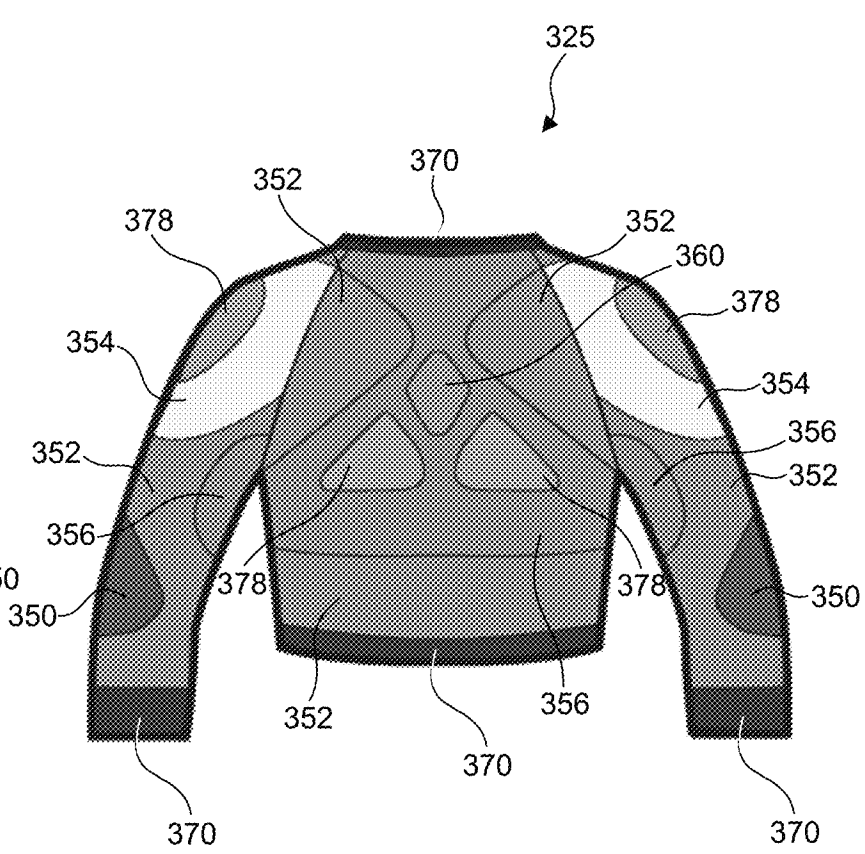
FIG. 14B illustrates a rear view of a sports garment according to some embodiments.
Figure 14A:
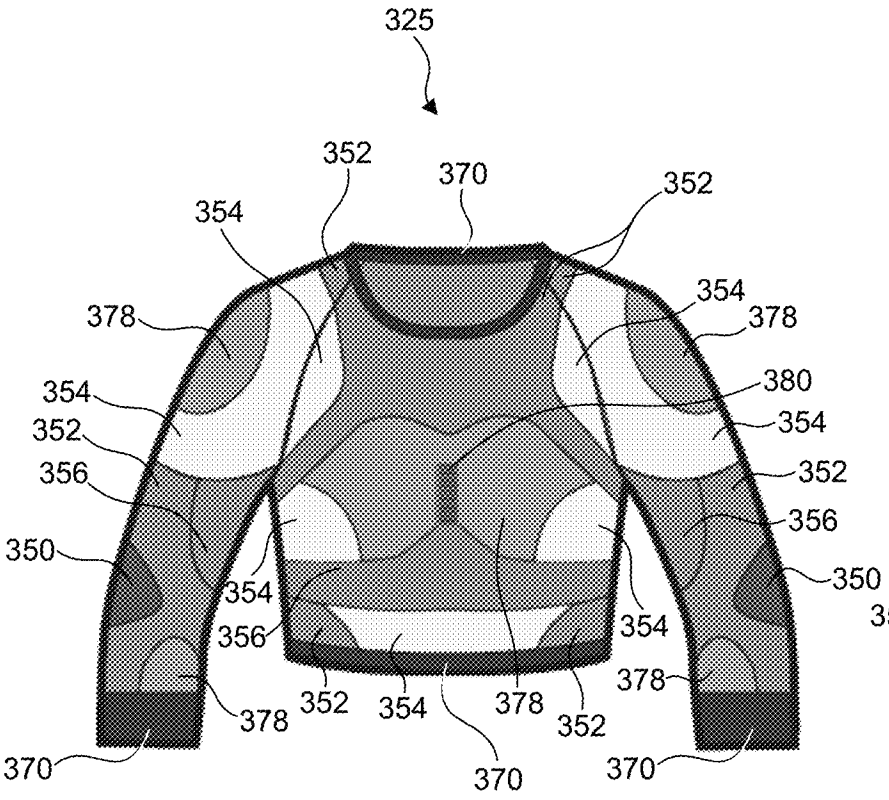
FIG. 14A illustrates a front view of a sports garment according to some embodiments.

In some embodiments, the sports garment is a shirt 325, as shown, for example, in FIGS. 14A and 14B. Shirt 325 may include zones of low compression 350, medium compression 352, high compression 354, and/or extra high compression 356; zones of small hole mesh 360, tubular construction 370, and/or piquet stitch 378; and a breast shaping/separation zone 380.

Shirt 325 may include one or more zones of extra high compression 356. For example, shirt 325 may include a zone of extra high compression 356 that extends circumferentially around shirt 325 just below a breast region. In some embodiments, this zone of extra high compression 356 extends over a greater portion of the back of shirt 325 than the front of shirt 325, as shown in FIG. 14B. For example, this zone of extra high compression 356 may extend up to a collar of shirt 325, with the outermost portion of the zone narrowing and then widening as it extends up the back of shirt 325. This zone of extra high compression 356 may be a motion-supporting compression zone 20 and/or a body-shaping compression zone 30. In some embodiments, shirt 325 includes a zone of extra high compression 356 disposed on an inner arm of shirt 325. For example, this zone may extend from an armpit region to an elbow region of the sleeve of shirt 325. This zone of extra high compression 356 may be a motion-supporting compression zone 20.

Shirt 325 may include one or more zones of high compression 354. In some embodiments, shirt 325 includes two zones of high compression 354 on an outer, lower portion of the breast region of shirt 325. These zones of high compression 354 may be a body-shaping compression zone 30 (e.g., to lift the breasts). In some embodiments, shirt 325 includes a zone of high compression 354 disposed over an abdomen of shirt 325. This zone of high compression 354 may be a body-shaping compression zone 30 (e.g., to flatten the abdomen). In some embodiments, shirt 325 includes zones of high compression 354 disposed at the shoulders of shirt 325. These zones of high compression 354 may be donut-shaped and extend from above the shoulder to a triceps region of shirt 325. These zones of high compression 354 may be a motion-supporting compression zone 20.

Shirt 325 may include one or more zones of medium compression 352. For example, a zone of medium compression 352 may be disposed on a lower back portion of shirt 325 and may extend around to a front of shirt 325 on both sides. This zone of medium compression 352 may be a body-shaping compression zone 30. In some embodiments, shirt 325 includes a zone of medium compression 352 at a front portion of shirt 325 above the breast region of shirt 325. This zone of medium compression 352 may be a motion-supporting compression zone 20. In some embodiments, shirt 325 includes zones of medium compression 352 disposed at an upper back portion of shirt 325 (e.g., at a shoulder blade region of shirt 325). These zones of medium compression 352 may be motion-supporting compression zones 20 and/or body-shaping compression zones 30. In some embodiments, shirt 325 includes zones of medium compression 352 disposed on the sleeves of shirt 325, as shown in FIGS. 14A and 14B. These zones of medium compression 352 may be motion-supporting compression zones 20. Shirt 325 may include one or more zones of low compression 350. In some embodiments, a zone of low compression 350 may be disposed at each elbow of shirt 325. The zone of low compression 350 may be a motion-supporting compression zone 20.

In some embodiments, zones of tubular construction 370 are disposed around a lower portion of the torso of shirt 325, the end of sleeves of shirt 325, and/or a collar of shirt 325.

In some embodiments, the tubular construction 370 comprises two layers of material, as discussed above. In some embodiments, tubular construction 370 may be elastic. In some embodiments, zones of piquet stitch 378 are disposed at a breast region of shirt 325. Piquet stitch 378 may provide an opaque textile so that shirt 325 is not see-through at the breast region. In some embodiments, shirt 325 includes zones of piquet stitch 378 at a shoulder of shirt 325, near an end of sleeves of shirt 325, and/or at a central back portion of shirt 325. In some embodiments, shirt 325 includes a zone of small hole mesh 360 disposed at a central back portion of shirt 325 (e.g., located above two zones of piquet stitch 378). The zone of small hole mesh 360 may be a ventilation zone 40.

In some embodiments, a breast shaping/separation zone 380 is also disposed at a breast region of shirt 325. In some embodiments, breast shaping/separation zone 380 is disposed within the zone of piquet stitch 378, as shown in FIG. 14A. Breast shaping/separation zone 380 may shape and separate the two breasts. In some embodiments, breast shaping/separation zone 380 comprises a ruching.

Figure 15B:
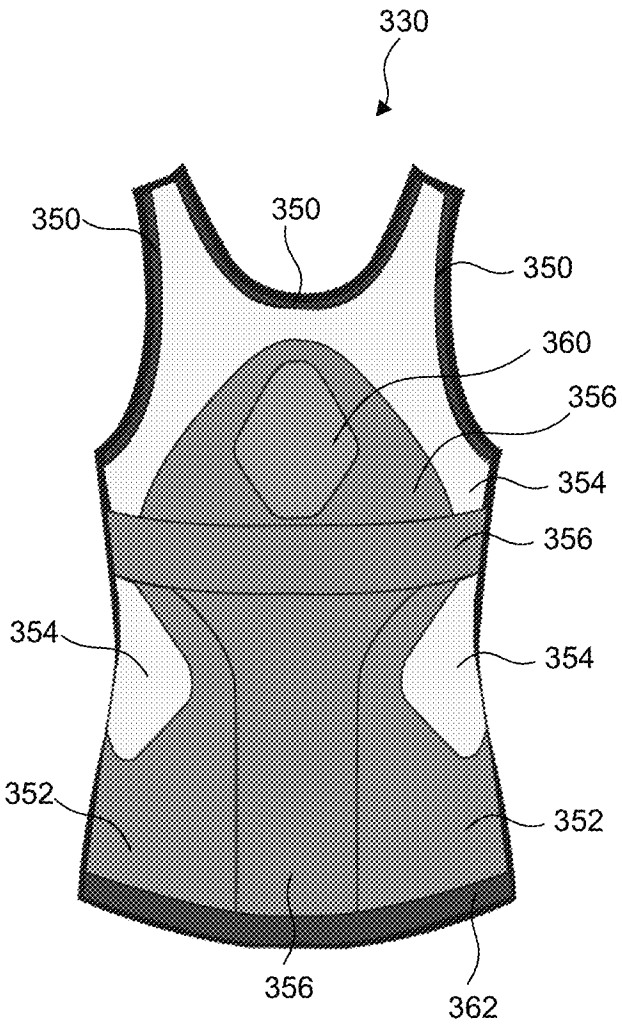
FIG. 15B illustrates a rear view of a sports garment according to some embodiments.
Figure 15A:
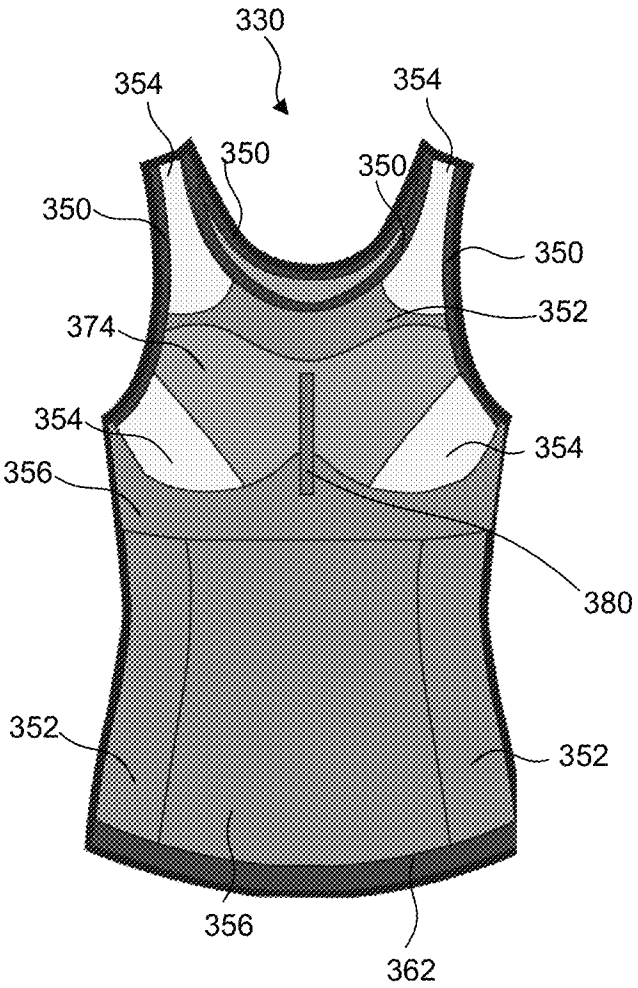
FIG. 15A illustrates a front view of a sports garment according to some embodiments.

In some embodiments, the sports garment is a tank top 330, as shown, for example, in FIGS. 15A and 15B. Tank top 330 may include zones of low compression 350, medium compression 352, high compression 354, and/or extra high compression 356; zones of small hole mesh 360, large hole mesh 362, and/or half Milano stitch 374; and a breast shaping/separation zone 380.

Tank top 330 may include one or more zones of extra high compression 356. For example, tank top 330 may include a zone of extra high compression 356 that extends circumferentially around tank top 330 just below a breast region. This zone of extra high compression 356 may be a body-shaping compression zone 30 (e.g., to lift the breasts). In some embodiments, a zone of extra high compression 356 is disposed over the abdominal region of tank top 330 from a breast region to a waist region. This zone of extra high compression 356 may be a body-shaping compression zone 30 (e.g., to flatten the abdomen). In some embodiments, zones of extra high compression 356 are disposed on a back of tank top 330 both above and below the circumferential zone of extra high compression 356 discussed above. The zone of extra high compression 356 below the circumferential zone may be disposed in a central lower portion of the back and extend down to a waist of tank top 330. The zone of extra high compression 356 above the circumferential zone may be disposed in a central upper portion of the back and extend in a semi-circular shape. These zones of extra high compression 356 may be motion-supporting compression zones 20.

Tank top 330 may include one or more zones of high compression 354. In some embodiments, tank top 330 includes two zones of high compression 354 on an outer, lower portion of the breast region of tank top 330. These zones of high compression 354 may be a body-shaping compression zone 30 (e.g., to lift the breasts). In some embodiments, tank top 330 includes a zone of high compression 354 extending from a front portion of tank top 330 (e.g., above a breast region of tank top 330), along the straps of tank top 330 to an upper, back portion of tank top 330 (e.g., above the semi-circular zone of extra high compression 356), as shown in FIGS. 15A and 15B. This zone of high compression 354 may be a motion-supporting compression zone 20. In some embodiments, tank top 330 includes zones of high compression 354 disposed at back side regions of tank top 330. This zone of high compression 354 may be a body-shaping compression zone 30 (e.g., to flatten the sides of the torso, providing a slimming appearance).

Tank top 330 may include one or more zones of medium compression 352. For example, zones of medium compression 352 may be disposed on each side of tank top 330, extending from a lower back portion of tank top 330 to a front of tank top 330 on both sides. These zones of medium compression 352 may be a body-shaping compression zone 30 (e.g., to flatten the sides of the torso, providing a slimming appearance). In some embodiments, tank top 330 includes a zone of medium compression 352 at a front portion of tank top 330 above the breast region of tank top 330. This zone of medium compression 352 may be a motion-supporting compression zone 20. Tank top 330 may include one or more zones of low compression 350. In some embodiments, a zone of low compression 350 may be disposed at the edges of tank top 330 (e.g., the collar and arm holes of tank top 330).

In some embodiments, a zone of large hole mesh 362 is disposed around a lower portion of the torso of tank top 330. The zone of large hole mesh 362 may be a ventilation zone 40. In some embodiments, zones of half Milano stitch 374 are disposed at a breast region of tank top 330. Half Milano stitch 374 may provide an opaque textile so that tank top 330 is not see-through at the breast region. In some embodiments, tank top 330 includes a zone of small hole mesh 360 disposed at a central back portion of tank top 330. The zone of small hole mesh 360 may be a ventilation zone 40.

In some embodiments, a breast shaping/separation zone 380 is also disposed at a breast region of tank top 330. In some embodiments, breast shaping/separation zone 380 is disposed within the zone of half Milano stitch 374, as shown in FIG. 15A. Breast shaping/separation zone 380 may shape and separate the two breasts. In some embodiments, breast shaping/separation zone 380 comprises a ruching.

Figure 16B:
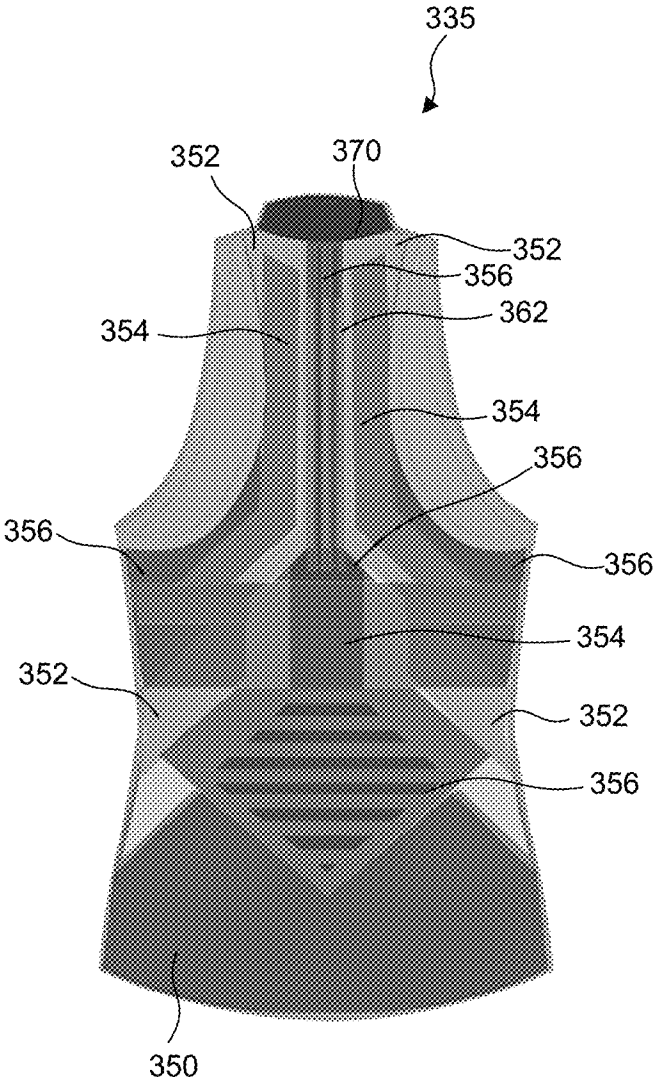
FIG. 16B illustrates a rear view of a sports garment according to some embodiments.
Figure 16A:
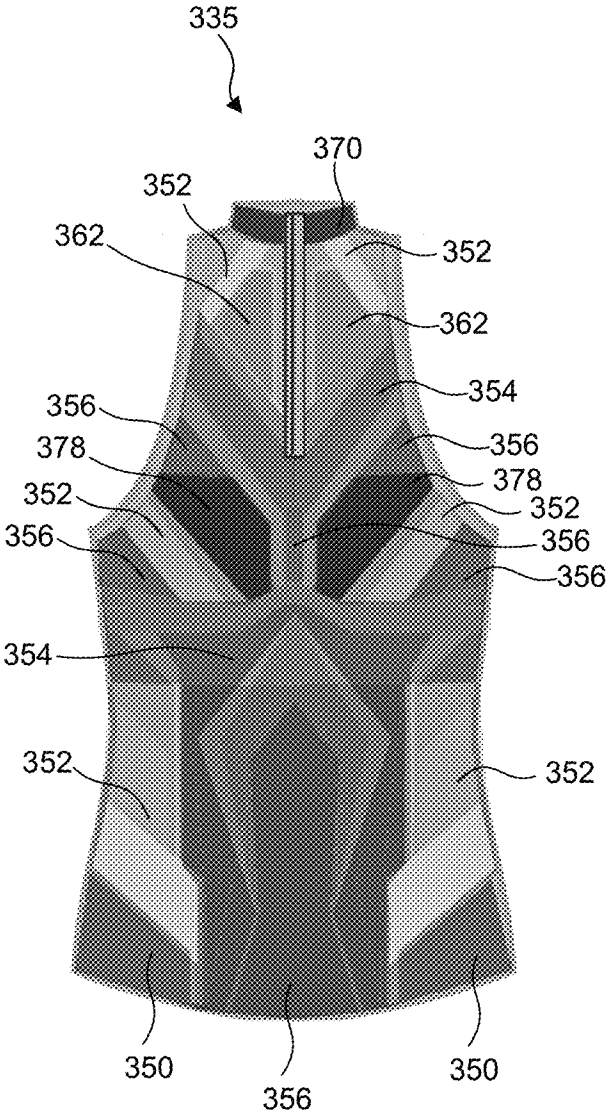
FIG. 16A illustrates a front view of a sports garment according to some embodiments.

In some embodiments, the sports garment is a tank top 335, as shown, for example, in FIGS. 16A and 16B. Tank top 335 may include zones of low compression 350, medium compression 352, high compression 354, and/or extra high compression 356; and zones of large hole mesh 362, tubular construction 370, and/or piquet stitch 378.

Tank top 335 may include one or more zones of extra high compression 356. For example, tank top 335 may include a zone of extra high compression 356 disposed over the abdominal region of tank top 335 from a breast region to a waist region. This zone of extra high compression 356 may be a body-shaping compression zone 30 (e.g., to flatten the abdomen). In some embodiments, tank top 335 includes two zones of extra high compression 356 on an outer, lower portion of the breast region of tank top 335 and extending around to a back of tank top 335 (e.g., disposed around a bottom portion of the arm holes). These zones of extra high compression 356 may be a body-shaping compression zone 30 (e.g., to lift the breasts). In some embodiments, tank top 335 includes a rectangular zone of extra high compression 356 disposed in the breast region between the two breasts. In some embodiments, this zone of extra high compression 356 is a body-shaping compression zone 30. For example, this zone of extra high compression 356 may shape and separate the two breasts. In some embodiments, this zone of extra high compression 356 comprises ruching. In some embodiments, tank top 335 includes zones of extra high compression 356 at a top portion of the breast region of tank top 335. These zones of extra high compression 356 may be body-shaping compression zones 30. In some embodiments, tank top 335 includes zones of extra high compression 356 in a back portion of tank top 335. For example, a lower back zone of extra high compression 356 may form a diamond-like shape, a central back zone of extra high compression 356 may form a trapezoidal shape, and an upper back zone of extra high compression 356 may form a rectangular shape. These back zones of extra high compression 356 may be motion-supporting compression zones 20.

Tank top 335 may include one or more zones of high compression 354. For example, tank top 335 may include a zone of high compression 354 that extends circumferentially around tank top 335 just below a breast region. This zone of extra high compression 356 may be a body-shaping compression zone 30 (e.g., to lift the breasts). In some embodiments, tank top 335 includes a zone of high compression 354 disposed above a breast region of tank top 335. This zone of high compression 354 may be Y-shaped and may surround the rectangular zone of extra high compression 356. This zone of high compression 354 may be a body-shaping compression zone 30. In some embodiments, tank top 335 includes two back zones of high compression 354 on an upper portion of the back of tank top 335. The zones may extend down from near the collar of tank top 335 and then extend down at an outward angle to stay near the edge of the arm holes of tank top 335. These zones of high compression 354 may be a motion-supporting compression zone 20.

Tank top 335 may include one or more zones of medium compression 352. For example, zones of medium compression 352 may be disposed on each side of tank top 335, extending from a lower back portion of tank top 330 to a front of tank top 330 on both sides. These zones of medium compression 352 may be a body-shaping compression zone 30 (e.g., to flatten the sides of the torso, providing a slimming appearance). In some embodiments, tank top 335 includes zones of medium compression 352 disposed at the shoulders of tank top 335. At the front of tank top 335, these zones may extend down from the shoulders on both sides of tank top 335 and in the middle of tank top 335. At the back of tank top 335, these zones may extend down from the shoulder on both sides of tank top 335 and between the two zones of high compression 354, as shown in FIG. 16B. In some embodiments, tank top 335 includes two zones of medium compression 352 on an outer, lower portion of the breast region of tank top 335 inside of the two zones of extra high compression 356. These zones of medium compression 352 may be a body-shaping compression zone 30 (e.g., to lift the breasts). Tank top 335 may include one or more zones of low compression 350. For example, a zone of low compression 350 may be disposed across the lower back portion of tank top 335 and extending around to the front of tank top 335 on both sides.

In some embodiments, a zone of tubular construction 370 is disposed around a collar of tank top 335. In some embodiments, the tubular construction 370 comprises two layers of material, as discussed above. In some embodiments, tubular construction 370 may be elastic. In some embodiments, zones of piquet stitch 378 are disposed at a breast region of tank top 335 (e.g., above zones of medium compression 352). Piquet stitch 378 may provide an opaque textile so that tank top 335 is not see-through at the breast region. In some embodiments, tank top 335 includes zones of large hole mesh 362 disposed above the breast region at a front, central portion of tank top 335. In some embodiments, tank top 335 includes a zone of large hole mesh 362 at a back, central portion of tank top 335. The zones of large hole mesh 362 may be ventilation zones 40.

Figure 17B:
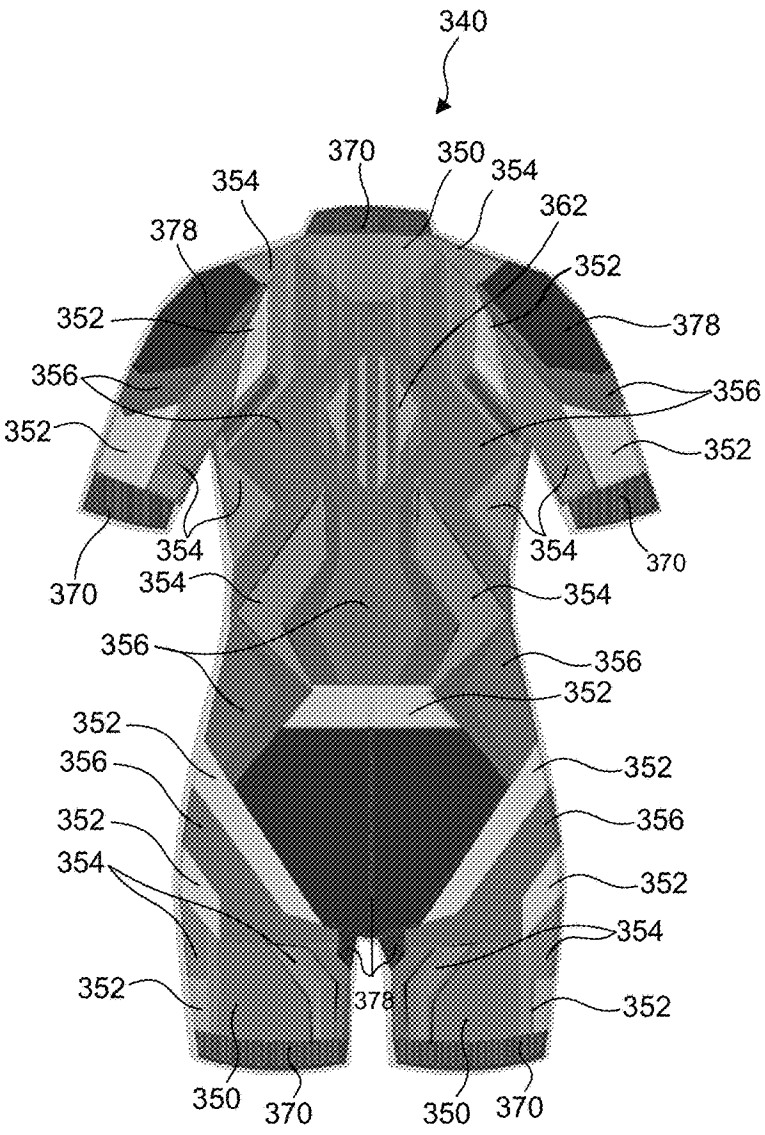
FIG. 17B illustrates a rear view of a sports garment according to some embodiments.
Figure 17A:
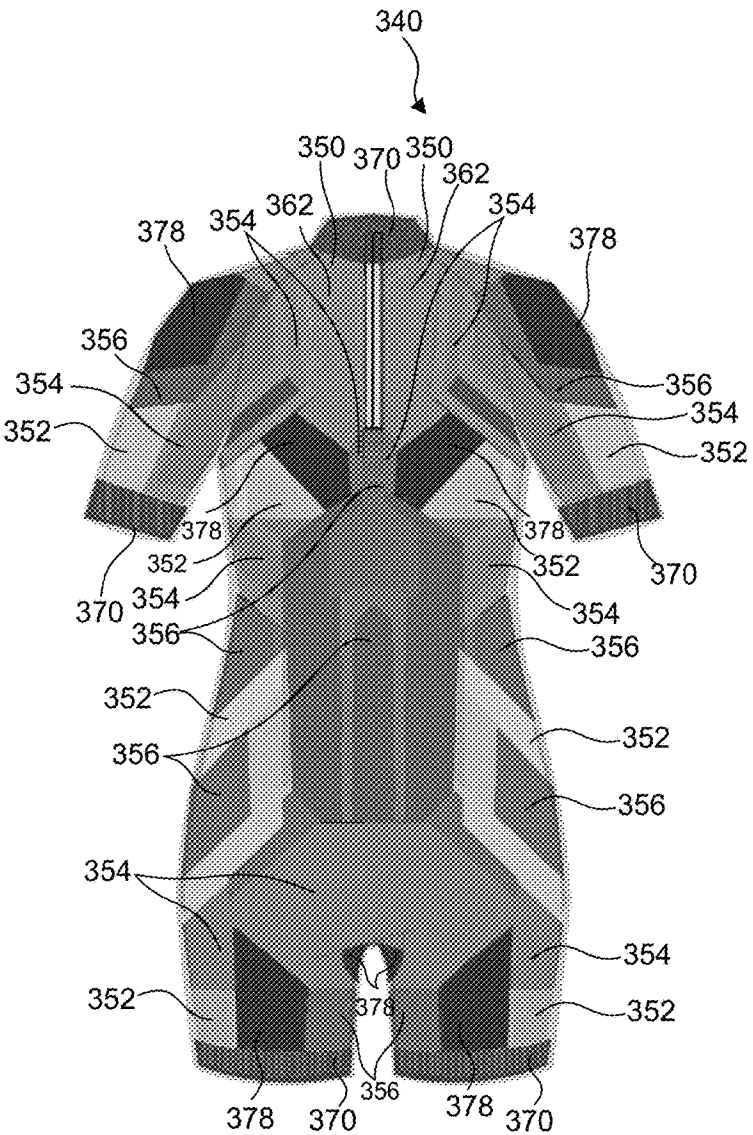
FIG. 17A illustrates a front view of a sports garment according to some embodiments.

In some embodiments, the sports garment is a bodysuit 340, as shown, for example, in FIGS. 17A and 17B. Bodysuit 350 may include zones of low compression 350, medium compression 352, high compression 354, and/or extra high compression 356; and zones of large hole mesh 362, tubular construction 370, and/or piquet stitch 378.

Bodysuit 340 may include one or more zones of extra high compression 356. For example, bodysuit 340 may include a zone of extra high compression 356 disposed over the abdominal region of bodysuit 340 from a breast region to a waist region. This zone of extra high compression 356 may be a body-shaping compression zone 30 (e.g., to flatten the abdomen). In some embodiments, bodysuit 340 includes a rectangular zone of extra high compression 356 disposed in the breast region between the two breasts. In some embodiments, this zone of extra high compression 356 is a body-shaping compression zone 30. For example, this zone of extra high compression 356 may shape and separate the two breasts. In some embodiments, this zone of extra high compression 356 comprises ruching. In some embodiments, bodysuit 340 includes zones of extra high compression 356 disposed at the legs of bodysuit 340. For example, the leg zones of extra high compression 356 may extend from the front of bodysuit 340 at a hip region around to the back of bodysuit 340 at the bottom of the buttocks region and around an inner thigh of bodysuit 340 (see FIGS. 17A and 17B). These zones of extra high compression 356 may be a motion-supporting compression zone 20 and/or a body-shaping compression zone 30. For example, the portion of this zone of extra high compression 356 at the hips and around the buttocks may lift the buttocks, and the portion of this zone of extra high compression 356 at the inner thigh may stimulate the inner thigh muscles and/or shape the inner thigh. In some embodiments, bodysuit 340 includes a zone of extra high compression 356 disposed at the back of bodysuit 340. This zone of extra high compression 356 may cover a large portion of the upper back and extend from near the collar down the center of the back to a waist region, as well as extending down the sides of the back (e.g., in a zig-zag fashion) and wrapping around to the front of bodysuit 340 at the waist region. This zone of extra high compression 356 may be a motion-supporting compression zone 20 and/or a body-shaping compression zone 30. For example, this zone may support the muscles in the upper back while also providing a slimming appearance at the sides of the torso. In some embodiments, bodysuit 340 includes zones of extra high compression 356 disposed at the shoulders of bodysuit 340. These zones of extra high compression 356 may be U-shaped and extend from its ends at the front and back of the shoulder and curve around at a triceps region of bodysuit 340. These zones of extra high compression 356 may be a motion-supporting compression zone 20.

Bodysuit 340 may include one or more zones of high compression 354. For example, bodysuit 340 may include a zone of high compression 354 that extends across the front of bodysuit 340 at a crotch region around both outer thighs (see FIGS. 17A and 17B). In some embodiments, this zone of high compression 354 is a motion-supporting compression zone 20 and/or a body-shaping compression zone 30. For example, the thigh portion of this zone of high compression 354 may support motion of the leg while the front crotch region may shape the lower portion of the torso. In some embodiments, the thigh portion of this zone of high compression 354 also shapes the thigh, thus forming a body-shaping compression zone 30. In some embodiments, bodysuit 340 includes inner thigh zones of high compression 354 disposed at a back portion of the leg of bodysuit 340. These inner thigh zones of high compression 354 may be motion-supporting compression zones 20. In some embodiments, bodysuit 340 includes zones of high compression 354 disposed at the upper torso of bodysuit 340. For example, these zones of high compression may extend around the shoulder (at both the front and back of bodysuit 340), on an underarm of the sleeves of bodysuit 340, and down the sides of the back of bodysuit 340 and around to the front of the bodysuit 340 just below the breast region. These zones of high compression 354 may be motion-supporting compression zones 20 (e.g., supporting movement of the shoulder and arm) and/or body-shaping compression zones 30 (e.g., to provide a slimming appearance and to shape fatty deposits at the shoulder blade). In some embodiments, bodysuit 340 includes zones of high compression 354 disposed at a breast region on each side of the rectangular zone of extra high compression 356. These zones of high compression 354 may be body-shaping compression zones 30 (e.g., to shape and separate the two breasts). In some embodiments, bodysuit 340 includes two back zones of high compression 354 disposed at a mid to lower portion of the back of bodysuit 340. These zones of high compression 354 may be motion-supporting compression zones 20.

Bodysuit 340 may include one or more zones of medium compression 352. For example, zones of medium compression 352 may be disposed at an outer thigh of each leg of bodysuit 340. These zones may be motion-supporting compression zones 20 and/or body-shaping compression zones 30. In some embodiments, bodysuit 340 includes zones of medium compression at the sides of bodysuit 340 around the hip, waist, and buttocks region. For example, these zones may extend from a bottom of the buttocks region, up around the bodysuit 340 at a diagonal to a waist region on the front of bodysuit 340, straight down to a hip region of bodysuit 340 and down around the bodysuit 340 at a diagonal to a top of the outer thigh. These zones of medium compression 352 may be body-shaping zones 30. In some embodiments, bodysuit 340 includes a zone of medium compression that extends horizontally across the top of a buttocks region. In some embodiments, bodysuit 340 includes two zones of medium compression 352 on an outer, lower portion of the breast region of bodysuit 340. These zones of medium compression 352 may be a body-shaping compression zone 30 (e.g., to lift the breasts). In some embodiments, bodysuit 340 includes zones of medium compression 352 at an outer arm of bodysuit 340. These zones of medium compression 352 may be motion-supporting compression zones 20. In some embodiments, bodysuit 340 includes zones of medium compression at an upper portion of the back of bodysuit 340 adjacent to the sleeves. These zones of medium compression 352 may be motion-supporting compression zones 20. Bodysuit 340 may include one or more zones of low compression 350. For example, zones of low compression 350 may be disposed at back of the thighs of bodysuit 340, at the top of the front and back of bodysuit 340 adjacent to the collar, and/or at the front of bodysuit 340 just above the breast region.

In some embodiments, zones of tubular construction 370 are disposed around a collar of bodysuit 340, the ends of the sleeves of bodysuit 340, and/or the ends of the legs of bodysuit 340. In some embodiments, the tubular construction 370 comprises two layers of material, as discussed above. In some embodiments, tubular construction 370 may be elastic. In some embodiments, zones of piquet stitch 378 are disposed at a breast region of bodysuit 340 (e.g., above zones of medium compression 352) and/or at a buttocks region and crotch region of bodysuit 340. Piquet stitch 378 may provide an opaque textile so that bodysuit 340 is not see-through at the breast region or the buttocks region. Bodysuit 340 may also include zones of piquet stitch 378 at the shoulders of bodysuit 340 and at the front of the thighs of bodysuit 340. In some embodiments, bodysuit 340 includes zones of large hole mesh 362 disposed above the breast region at a front, central portion of bodysuit 340. In some embodiments, bodysuit 340 includes a zone of large hole mesh 362 at a back, central portion of bodysuit 340. The zones of large hole mesh 362 may be ventilation zones 40.

Any of the zones described above with respect to one sports garment (e.g., 10, 100, 200, 300, 305, 310, 315, 320, 325, 330, 335, 340) may be used with other sports garments described herein.

Some embodiments are directed to a sports garment that includes a textile that forms two or more compression zones. In some embodiments, the compression zones include a motion-supporting compression zone that applies a first compressive force to a first area of a body and a body-shaping compression zone that applies a second compressive force to a second area of the body. In some embodiments, the first compressive force supports a motion of the first area of the body and the second compressive force shapes the second area of the body.

In any of the various embodiments discussed herein, the first area of the body may be at least one of a knee, an elbow, a shoulder, a back, a leg, or an arm.

In any of the various embodiments discussed herein, the second area of the body may be at least one of an abdominal region, a gluteal region, a waist region, a breast region, an inner thigh, an inner knee, an outer thigh, or a shoulder blade.

In any of the various embodiments discussed herein, the textile may be a moisture-wicking fabric. In any of the various embodiments discussed herein, the textile may be an opaque fabric. In any of the various embodiments discussed herein, the textile may be a breathable fabric.

In any of the various embodiments discussed herein, the sports garment may be an outer garment. In any of the various embodiments discussed herein, the sports garment may be opaque. In any of the various embodiments discussed herein, the textile may include a mesh, single jersey, or half Milano structure. In any of the various embodiments discussed herein, the sports garment may be at least one of a shirt, pants, shorts, leggings, or swimwear. In any of the various embodiments discussed herein, the sports garment may include no hardware.

In any of the various embodiments discussed herein, the textile may be formed into a shirt. In any of the various embodiments discussed herein, the textile may be formed into a pair of pants.

Some embodiments are directed to a sports garment that includes a first knitted textile that supports a motion of a first area of a body, a second knitted textile that shapes a second area of the body, and a third knitted textile that includes a mesh, single jersey, or half Milano structure. In some embodiments, the third knitted textile is disposed at a third area of the body. In some embodiments, the first knitted textile, the second knitted textile, and the third knitted textile are coupled seamlessly together.

In any of the various embodiments discussed herein, the first knitted textile, the second knitted textile, and the third knitted textile may be coupled together by knitting.

In any of the various embodiments discussed herein, the first knitted textile and the second knitted textile may be opaque.

In any of the various embodiments discussed herein, the first area of the body may be at least one of a knee, an elbow, a shoulder, a back, a leg, or an arm.

In any of the various embodiments discussed herein, the second area of the body may be at least one of an abdominal region, a gluteal region, a waist region, a breast region, an inner thigh, an inner knee, an outer thigh, or a shoulder blade.

In any of the various embodiments discussed herein, the sports garment may be an outer garment.

Some embodiments are directed to a method for manufacturing a sports garment that includes knitting a textile, modifying a first characteristic of the knitting to form a motion-supporting compression zone in the textile, and modifying a second characteristic of the knitting to form a body-shaping compression zone in the textile.

In any of the various embodiments discussed herein, the knitting may include circular knitting. In any of the various embodiments discussed herein, the first characteristic may include at least one of a type of yarn, a type of knitting stitch, or a density of the knit. In any of the various embodiments discussed herein, the first characteristic may be a different characteristic than the second characteristic. In any of the various embodiment discussed herein, the sports garment may include at least one of a shirt, pants, shorts, leggings, or swimwear. In any of the various embodiments discussed herein, knitting the textile may form the sports garment.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A sports garment comprising:

a textile forming a plurality of compression zones, the compression zones comprising:

a motion-supporting compression zone configured to apply a first compressive force to a first area of a body, the first compressive force configured to support a motion of the first area of the body, wherein the motion-supporting compression zone extends continuously around an entire circumference of an abdominal region of the sports garment, and wherein the motion-supporting compression zone extends over a greater portion of a back of the sports garment than a front of the sports garment by extending up the back of the sports garment to a collar of the sports garment; and a body-shaping compression zone configured to apply a second compressive force to a second area of the body, the second compressive force configured to shape the second area of the body, wherein a shape of the body-shaping compression zone is configured to contribute to shaping the second area of the body, and wherein the body-shaping compression zone extends to the front and the back of the sports garment, wherein the first compressive force is greater than the second compressive force and the first compressive force is achieved by a tunnel construction; and the back of the sports garment comprises two portions of the body-shaping compressive zone, and the motion-supporting compression zone extends between the two portions of the body-shaping compressive zone.

2. The sports garment of claim 1, wherein the first area of the body comprises at least one of a knee, an elbow, a shoulder, a back, a leg, or an arm.

3. The sports garment of claim 1, wherein the second area of the body comprises at least one of an abdominal region, a gluteal region, a waist region, a breast region, an inner thigh, an inner knee, an outer thigh, or a shoulder blade.

4. The sports garment of claim 1, wherein the sports garment is opaque.

5. The sports garment of claim 1, wherein the textile comprises a half Milano structure.

6. The sports garment of claim 1, wherein the sports garment comprises at least one of a shirt, pants, shorts, leggings, or swimwear.

7. The sports garment of claim 1, wherein the sports garment does not include any hardware.

8. A shirt comprising:

a plurality of motion-supporting compression zones comprising:

an elbow motion-supporting compression zone disposed at an area of the shirt configured to correspond to an elbow of a wearer and configured to apply a compressive force to support a motion of the elbow;

an upper back motion-supporting compression zone disposed at an area of the shirt configured to correspond to an upper back of the wearer and configured to apply a compressive force to support a motion of the upper back; and an arm motion-supporting compression zone disposed at an area of the shirt configured to correspond to an arm of the wearer and configured to apply a compressive force to support a motion of the arm;

a plurality of body-shaping compression zones comprising:

a breast body-shaping compression zone extending continuously across a center of a breast area of the front of the shirt and configured to apply a compressive force to shape the breast, wherein the breast body-shaping compression zone is defined by a first knitting structure that extends continuously across the front of the shirt;

an abdominal body-shaping compression zone defined by a second knitting structure disposed at an area of the shirt configured to correspond to abdominals of the wearer and configured to apply a compressive force to shape the abdominals, wherein the first knitting structure differs from the second knitting structure by type of yarn, type of knit stitch, or a density of knit, wherein the abdominal body-shaping compression zone extends continuously across a front of a torso of the shirt, below the breast body-shaping compression zone, and around the torso of the shirt from the front of the torso to a back of the torso, wherein the upper back motion-supporting compression zone bisects the abdominal body-shaping compression zone at the back of the torso, and wherein the abdominal body-shaping compression zone comprises a tapered shape at the front of the torso of the shirt, the tapered shape extending along a bottom edge of the abdominal body-shaping compression zone; and a shoulder-blade body-shaping compression zone disposed at an area of the shirt that corresponds to a shoulder blade of the wearer and configured to apply a compressive force to shape the shoulder blade; and a plurality of ventilation zones comprising a chest ventilation zone disposed at an area of the shirt configured to correspond to a chest of the wearer, a lower back ventilation zone disposed at an area of the shirt configured to correspond to a lower back of the wearer, and an underarm ventilation zone disposed at an area of the shirt configured to correspond to an underarm of the wearer;

wherein compressive forces applied by each of the motion-supporting compression zones are different from compressive forces applied by each of the body-shaping compression zones.

9. The shirt of claim 8, wherein the breast body-shaping compression zone comprises ruching.

10. The shirt of claim 8, wherein the breast body-shaping compression zone extends circumferentially around the shirt.

11. The shirt of claim 8, wherein at least one of the motion-supporting compression zones comprises a dual-layer textile.

12. The shirt of claim 11, wherein the dual-layer textile comprises a tubular construction.

13. A sports garment comprising:

a textile forming a plurality of compression zones, the compression zones comprising:

a motion-supporting compression zone configured to apply a first compressive force to a first area of a body, the first compressive force configured to support a motion of the first area of the body, wherein the motion-supporting compression zone extends continuously around an entire circumference of an abdominal region of the sports garment, and wherein the motion-supporting compression zone extends over a greater portion of a back of the sports garment than a front of the sports garment by extending up the back of the sports garment to a collar of the sports garment; and a body-shaping compression zone configured to apply a second compressive force to a second area of the body, the second compressive force configured to shape the second area of the body, wherein a shape of the body-shaping compression zone is configured to contribute to shaping the second area of the body, and wherein the body-shaping compression zone extends to the front and the back of the sports garment, wherein the first compressive force is greater than the second compressive force; and the back of the sports garment comprises two portions of the body-shaping compressive zone, and the motion-supporting compression zone extends between the two portions of the body-shaping compressive zone.

14. The sports garment of claim 13, wherein the first area of the body comprises at least one of a knee, an elbow, a shoulder, a back, a leg, or an arm.

15. The sports garment of claim 13, wherein the second area of the body comprises at least one of an abdominal region, a gluteal region, a waist region, a breast region, an inner thigh, an inner knee, an outer thigh, or a shoulder blade.

16. The sports garment of claim 13, wherein the sports garment is opaque.

17. The sports garment of claim 13, wherein the textile comprises a half Milano structure.

18. The sports garment of claim 13, wherein the sports garment comprises at least one of a shirt, pants, shorts, leggings, or swimwear.

19. The sports garment of claim 13, wherein the sports garment does not include any hardware.

* * * * *